United States Patent [19]

Shigemura et al.

[11] Patent Number: 4,515,464

[45] Date of Patent: May 7, 1985

[54] COPYING APPARATUS HAVING A COPY SHEET SORTER

[75] Inventors: Yutaka Shigemura; Hiroshi Kimura; Masahiko Hisajima; Isao Yada; Yoichiro Irie; Kiyoshi Morimoto; Yasuhiko Yoshikawa; Takashi Nagashima, all of Osaka, Japan

[73] Assignee: Mita Industrial Company Limited, Osaka, Japan

[21] Appl. No.: 426,156

[22] Filed: Sep. 28, 1982

[30] Foreign Application Priority Data

Oct. 9, 1981 [JP] Japan ..... 56-162205

[51] Int. Cl.[3] ..... G03G 15/00

[52] U.S. Cl. ..... 355/14 R; 355/14 SH; 355/14 CU

[58] Field of Search ..... 355/14 R, 14 CU, 14 SH, 355/3 SH

[56] References Cited

U.S. PATENT DOCUMENTS 4,204,727 5/1980 Tates ..... 355/3 R
4,330,200 5/1982 Kituchi et al. ..... 355/14 SH
4,385,827 5/1983 Naramore ..... 355/14 SH

*Primary Examiner*—R. L. Moses
*Attorney, Agent, or Firm*—Wenderoth, Lind & Ponack

[57] ABSTRACT

A copying apparatus includes a sorter which is arranged to sort a plurality of copy paper sheets corresponding to a single original document, discharged from a main body of the copying apparatus, into a plurality of bins successively shifted to a paper discharge position by a shifting device. The copying apparatus includes a copy number preset key, a memory for memorizing a preset number of copies, a first counter for counting the number of copied paper sheets, a second counter for counting the number of discharged copy paper sheets, a device for stopping the copying operation when the counted value of the first counter agrees with the memorized preset number of copies, and a sort key for selecting a mode for sorting the copy paper sheets into the bins one sheet in each bin. An electrical circuit applies signals to the shifting device in order to change the moving direction of the bins when the counted value of the second counter agrees with the memorized preset number of copies in the sort mode.

14 Claims, 13 Drawing Figures

COPYING APPARATUS HAVING A COPY SHEET SORTER

BACKGROUND OF THE INVENTION

1. Field of the Invention

The present invention generally relates to a copying apparatus and more particularly, to a copying apparatus equipped with a sorter which is arranged to sort a plurality of copy paper sheets discharged from a main body of the copying apparatus into a plurality of bins successively shifted to a paper discharge position by a shifting means.

2. Description of the Prior Art

Conventionally, a sorter of the above described type is capable of functioning in a mode for classifying copy paper sheets discharged from the copying apparatus main body, one sheet at a time, i.e. in the so-called sort mode, and also in another mode for classifying such copy paper sheets by the preliminarily set number of sheets to be copied, i.e. in the so-called group mode.

In the prior art it has been generally so arranged that, upon detection that the copy paper sheets are not discharged from a paper discharge port of the copying apparatus main body, even after lapse of a predetermined period of time, in the sort mode as described above, the direction for shifting the bins is changed over on the assumption that the copy paper sheets are classified and sorted into the respective bins, one sheet in each bin, by the number of sheets to be copied preliminarily set. In the known arrangements as described above, even when paper jamming has taken place within the copying apparatus main body, or when the copy paper sheets in a copy paper feeding cassette have been used up, a detection is made that the copy paper sheets are not discharged from the copy paper discharge port of the copying apparatus main body after lapse of the predetermined period of time, and thus, the shifting direction of the bins is altered. Accordingly, in the prior art arrangements as described above, the shifting direction of the bins is undesirably changed over in spite of the fact that the preliminarily set number of sheets to be copied has not been sorted into the respective bins.

Similarly, in the group mode also, shifting to a subsequent bin is undesirably effected despite the fact that the preliminarily set number of sheets to be copied has not been classified and accommodated into one bin.

The prior art arrangements have the further following disadvantages.

(1) In the sort mode and group mode, when the bins are to be moved, other than for sorting of the copy paper sheets discharged from the copying apparatus main body, for example when the disposition of the bins is to be changed over, the copying apparatus is still allowed to effect copying. Therefore, if the copying apparatus is operated to perform a copying operation by mistake, copy paper sheets discharged from the copying apparatus main body are held or caught by the bins during shifting thereof, thus giving rise to paper jamming.

(2) In the sort mode and group mode, shifting of the bins is not effected even if an interruption copying operation is carried out. Accordingly, there occurs the disadvantage that copy paper sheets corresponding to an original document initially being copied, and copy paper sheets corresponding to another original document of the interruption copying operation, are not separated from each other and are not sorted into the bins in a properly classified manner, thus requiring an operator to sort them after completion of the copying operation, with a consequent troublesome procedure involved.

It is an essential object of the present invention to provide a novel copying apparatus which is capable of solving the technical problems described above such as copy paper jamming in the sorter, with a simultaneous improvement of operability and with successful of copy paper sheets.

Another object of the invention is to provide an improved electrostatic copying apparatus in which the copied paper sheets are sorted into a predetermined bin when interruption copying is performed, whereby an operator thus is capable of performing a copying operation easily.

SUMMARY OF THE INVENTION

To accomplish the foregoing objectives, there is provided a copying apparatus equipped with a sorter which is arranged to sort a plurality of copy paper sheets corresponding to a single original document, discharged from a main body of the copying apparatus, into a plurality of bins successively shifted to a paper discharge position by a shifting means.

The copying apparatus comprises a copy number preset key for setting the number of copies to be made memory means for memorizing the preset number of copies to be made, a first counter for counting the number of copied paper sheets according to a single copying operation of the copying apparatus, a second counter for counting the number of copy paper sheets discharged from the copying apparatus, means for stopping the copying operation of the copying apparatus when the counted value of the first counter agrees with the preset number of copies memorized in the memory means, a sort key for selecting a mode for sorting the copy paper sheets into the bins, one single sheet in each bin, and an electrical circuit for applying signals to a shifting means in order to change the moving direction of the bins when the counted value of the second counter agrees with the memorized preset number of copies in the sort mode.

According to the present invention, in the mode for sorting the copy paper sheets into the bins, one sheet in each bin, since the change-over of the moving direction of the bins is effected upon coincidence of the preliminarily set number of sheets to be copied with the number of discharged sheets, the bins are not changed over in the shifting direction thereof undesirably, even when paper jamming takes place or when copy paper sheets to be supplied are used up in the copying apparatus main body. Therefore, it is possible to effect or sorting correctly.

The copying apparatus comprises a copy number preset key for setting the number of copies to be made, memory means for memorizing the preset number of copies to be made, a first counter for counting the number of copied paper sheets according to a single of copying operation the copying apparatus, a second counter for counting the number of copy paper sheets discharged from the copying apparatus, means for stopping the copying operation of the copying apparatus when the counted value of the first counter agrees with the preset number of copies memorized in the memory means, a group key for selecting a mode for sorting a predetermined number of the copy paper sheets into each of the bins, and an electrical circuit for applying signals to the shifting means in order to shift the bins when the counted value of the second counter agrees with the number of copies preset by the copy number preset key in the group mode.

According to the invention, in the mode for sorting the preliminarily set number of copy paper sheets into each of the bins since the shifting of the bins is effected upon coincidence of the preliminarily set number of sheets to be copied with the number of sheets discharged, the bins are not shifted even when paper jamming occurs or when the copy paper supply is empty. Therefore, the preliminarily set number of copy paper sheets are sorted into the respective bins, thus making it possible to effect classification correctly.

The copying apparatus comprises a copy number preset key for setting the number of copies to be made, means for revising the preset number of copies to be made, a sort key for selecting a mode for sorting the copy paper sheets into the bins, one sheet in each bin, and an electrical circuit for applying signals to the shifting means in order to change the moving direction of the bins so that the bins may return to the original position in such mode when the preset number is revised.

According to the invention, in the mode sorting the copy paper sheets into the bins, one sheet in each bin, since it is arranged that, if the preliminarily set number of sheets to be copied is corrected, the bins are changed over in the shifting direction thereof so as to be returned to the position before starting of the shifting, the work required for checking the bins in which copy paper sheets, after completion of the copying operation, are supplied is unnecessary, with a consequent facilitation of the work involved.

The copying apparatus comprises a copy number preset key for setting the number of copies to be made, means for revising the preset number of copies to be made a group key for selecting a mode for sorting a predetermined number of the copy paper sheets into each of the bins, and an electrical circuit for applying signals to the shifting means in order to shift the bins so that the next bin is at the discharge position when the preset number of copies is revised under the condition that the copied paper sheets are in the bin at the discharge position in such mode.

According to the invention, in the mode for sorting the copy paper sheets, of a number equal to the preliminarily set number, into each of the bins, since the arrangement is so made that, if the preliminarily set number of sheets is corrected, the bins are shifted and the copy paper sheets after correction of the number of sheets are accommodated or sorted into the subsequent bin, there is no possibility that the copy paper sheets initially copied and the copy paper sheets after the correction are accommodated into the same bin. Therefore, the work required for confirmation of the number of copied sheets after completion of copying has been appreciably facilitated.

The copying apparatus comprises a copy number preset key for setting the number of copies of one original document to be made, an interruption key for copying another original document by interruption during the copying of the one original document, a memory means for memorizing the position of the respective bin when the interrupiton key is operated, a sort key for selecting a mode for sorting the copy paper sheets into the bins, one single sheet in each bin, and/or a group key for selecting a mode for sorting a predetermined number of the copy paper sheets into each of the bins, and an electrical circuit for applying signals to the shifting means for shifting a predetermined bin to the discharge position according to the operation of the interruption key, and for applying signals to the shifting means for shifting the bin to the position memorized by the memory means when the interruption copying operation is completed in such modes.

According to the invention, in the modes for sorting the copy paper sheets into the bins, one sheet in each bin, and by the preliminarily set number of sheets to be copied into each bin, since the copy paper sheets subjected to interruption copying are accommodated into a predetermined bin, undesirable sorting of the copy paper sheets of the interruption copying operation into the bins in which the copy paper sheets have been supplied in the respective modes as described above, can be prevented. Thus, the work required for the operator to sort the copied sheets after completion of copying is eliminated, with a consequent facilitation of the work involved.

The copying apparatus comprises a copy number preset key for setting the number of copies to be made, a sort key for selecting a mode for sorting the copy paper sheets into the bins, one sheet in each bin, and/or a group key for selecting a mode for sorting a predetermined number of the copy paper sheets into each of the bins, and means for stopping the copying operation of the copying apparatus when the bins are shifted, except for when the bins are shifted successively, regardless of the operation of the print button.

According to the invention, in the modes for sorting the copy paper sheets into the bins, by one sheet in each bin, and by the preliminarily set number of sheets to be copied into each bin, since the copying function of the copying apparatus is suppressed, when the bins are shifted in the case other than when the copy paper sheets discharged from the copying apparatus main body are sorted, there is no possibility that the copy paper sheets will be discharged into the sorter, and therefore the occurrence of undesirable paper jamming due to holding of the copy paper sheets by the bins during shifting within the sorter may be advantageously prevented.

The copying apparatus comprises a copy number preset key for setting the number of copies to be made, memory means for memorizing the preset number of copies to be made, a first counter for counting the number of copied paper sheets according to a single copying operation of the copying apparatus, means for stopping the copying operation of the copying apparatus when the counted value of the first counter agrees with the preset number of copies memorized in the memory means, a sort key for selecting a mode for sorting the copy paper sheets into the bins, one sheet in each bin, and/or a group key for selecting a mode for a predetermined number of the copy paper sheets into each of the bins, and means for applying signals to the shifting means in order to return a predetermined bin to the discharge position after a predetermined period from the time when the copying operation stops in such modes.

According to the invention, in the modes for sorting the copy paper sheets into the bins, by one sheet into each bin, and by the preliminarily set number of sheets to be copied into each bin, since it is so arranged that when a predetermined period of time has elapsed after completion of the copying function by the copying apparatus, the predetermined bin is brought into the paper discharge position of the copying apparatus main body on the assumption that the copying has been completed, the procedure for bringing the predetermined bin to the paper discharge position during subsequent copying has been made unnecessary. Thus, the operability of the copying apparatus has been markedly improved.

BRIEF DESCRIPTION OF THE DRAWINGS

This invention will now be described in more detail with reference to the accompanying drawings, wherein.

DETAILED DESCRIPTION OF THE PREFERRED EMBODIMENT

The present invention generally relates to a copying apparatus and more particularly, to a copying apparatus equipped with a sorter which is arranged to sort a plurality of copy paper sheets discharged from a main body of the copying apparatus, into a plurality of bins successively shifted to a paper discharge position by a shifting means.

Figure 1:
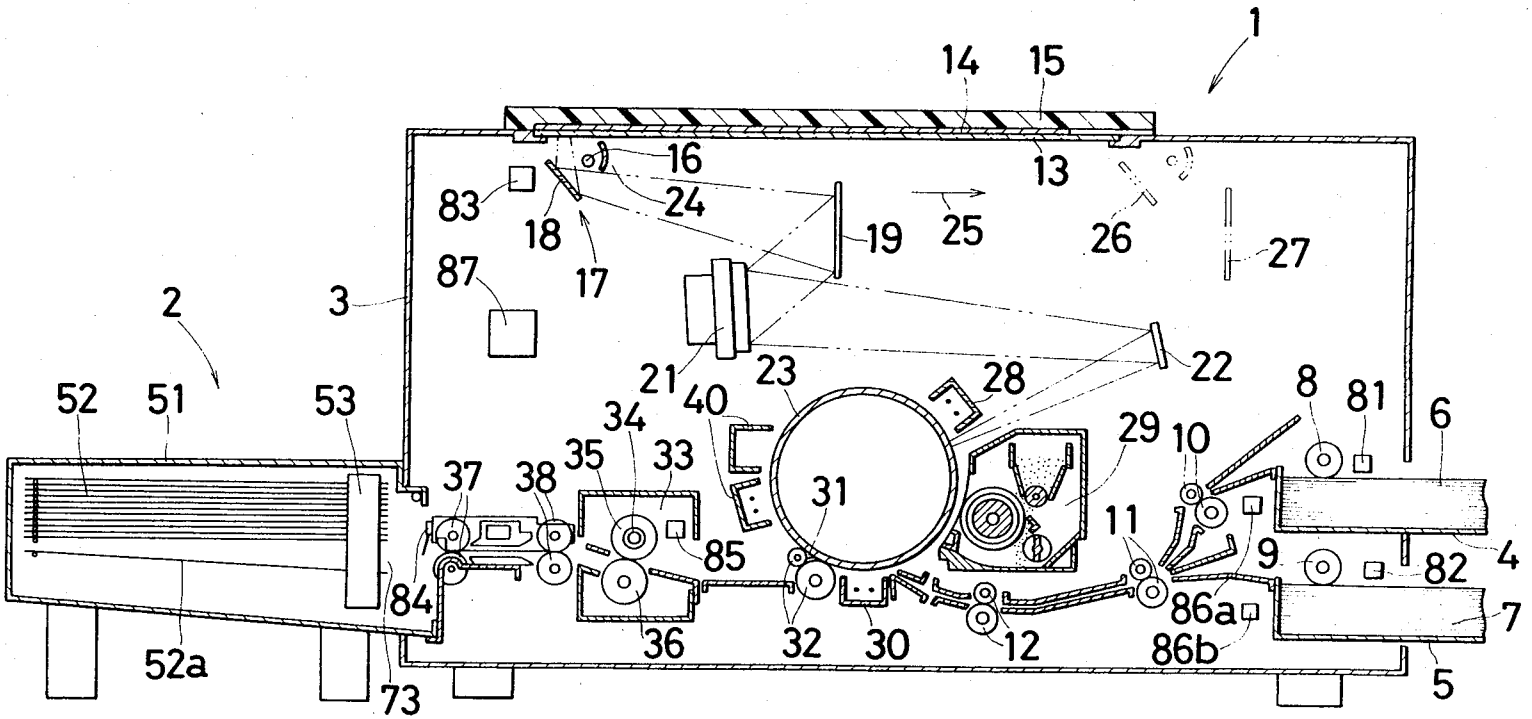
FIG. 1 is a schematic vertical cross-sectional view of one preferred embodiment of the present invention.

FIG. 1 is a schematic vertical cross-sectional view of one preferred embodiment of the present invention. This electrostatic copying apparatus includes a sorter 2 for classifying a plurality of copy paper sheets discharged from a copying apparatus main body 1. Copy paper sheets 6, 7 in cassettes 4 and 5 provided at a side of a housing 3 for the copying apparatus main body 1 are fed from the cassettes 4 and 5 by feeding rollers 8 and 9 alternatively one by one, and are transported by transport rollers 10, 11 and 12. A horizontal transparent plate 13 is provided at the upper portion of the housing 3. An original document 14 is pressed in close adherence onto the original transparent plate 13 by an original document cover 15. Light of an exposure lamp 16 is directed to the original document 14 through the transparent plate 13. A light image of the original document 14 is directed, through mirrors 18 and 19, a mirror lens 21 and a mirror 22 of an optical device 17, onto the surface of a photosensitive drum 23. Mirror 24 is provided in the vicinity of the exposure lamp 16 so as to guide efficiently the light from the exposure lamp 16 onto the original document 14. During exposure, the exposure lamp 16 and mirrors 18 and 24 are displaced in moving direction 25, from a home position shown by a continuous lines to a position 26 shown by imaginary line. After exposure is completed, the exposure lamp 16 and the mirrors 18 and 24 are returned to the home position. The mirror 19 is displaced with the exposure lamp 16 and the mirrors 18 and 24, and is at a position 27 shown by imaginary lines when the exposure lamp 16 and the mirrors 18 and 24 are at the position 26. The light image of the original document 14 is directed onto the photosensitive drum 23 charged by a corona charger 28, and an electrostatic latent image is formed on the peripheral surface of the photosensitive drum 23. The electrostatic latent image is developed to a visible image by a developing device 29. The toner image on the surface of the photosensitive drum 23 is transferred by a transfer corona charger 30 to the copy paper sheets 6, 7 being transported by transport rollers 12. The copy paper sheets 6, 7 having thereon the toner image are peeled or stripped from the photosensitive drum 23 by a peel click 31 and a peel roller 32, and are transported to a heating and fixing device 33. The heating and fixing device 33 comprises a heating roller 35 having a heater 34 therein and a press roller 36 being hard contact with the heating roller 35. When the copy paper sheets 6, 7 are transported between the heating roller 35 and the press roller 36 after the transfer step is performed, the toner on the copy paper sheets 6, 7 is fused by heating and the fixing step is performed. After the fixing step is performed, the copy paper sheets 6, 7 are discharged into the sorter 2 provided at the side of the housing 3 through transport rollers 38 and discharge rollers 37.

The sorter 2 includes a plurality of bins 52 to be shifted or moved by a shifting means 53 and accommodated in a casing 51. The copy paper sheets 6, 7 discharged by the discharge rollers 37 are supplied into the particular bin shifted to a paper discharge position 73. The sorter 2 is capable of functioning for a respective non-sort mode (A), a sort mode (B) and a group mode (C), according to the shifting modes of the bins 52 as follows.

(A) In the non-sort mode, a predetermined bin 52*a* of the bins 52 remains fixed at the paper discharge position 73. Therefore, the copy paper sheets 6, 7 discharged through the discharge rollers 37 are all supplied into the bin 52*a*.

(B) In the sort mode, each time the copy paper sheets 6, 7 are discharged through the paper discharge rollers 37 one sheet by one sheet, the bins 52 except the bin 52*a* are shifted one by one to confront the paper discharge position 73. Accordingly, the plurality of copy paper sheets 6, 7 discharged through the discharge rollers 37 are supplied one sheet into each of the bins 52.

(C) In the group mode function, each time a predetermined number of the copy paper sheets 6, 7 are discharged through the discharge rollers 37, the bins 52 except the bin 52*a* are shifted, one by one, to confront the paper discharge position 73. Accordingly, the plurality of copy paper sheets 6, 7 discharged through the discharge rollers 37 are sorted such that the predetermined number of sheets are supplied to each of the bins 52. In the manner described above, the sorter 2 is capable of sorting the plurality of copy paper sheets discharged from the copying apparatus main body 1. It is to be noted here that the surface of the photosensitive drum 23 after transfer is cleaned by a cleaning device 40.

Figure 2:
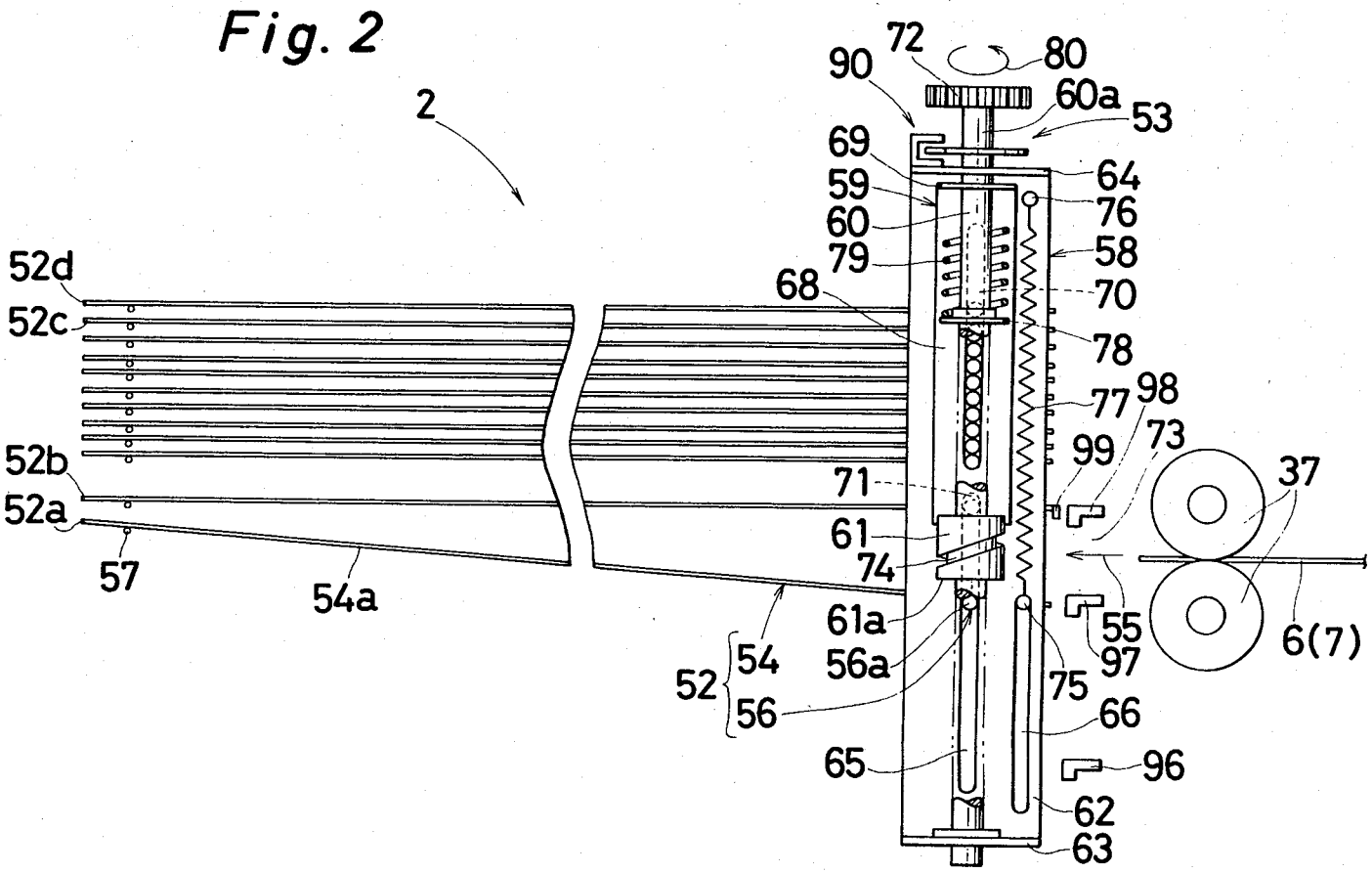
FIG. 2 is a front elevational view showing on an enlarged scale the main construction of a sorter as illustrated in FIG. 1.
Figure 3:
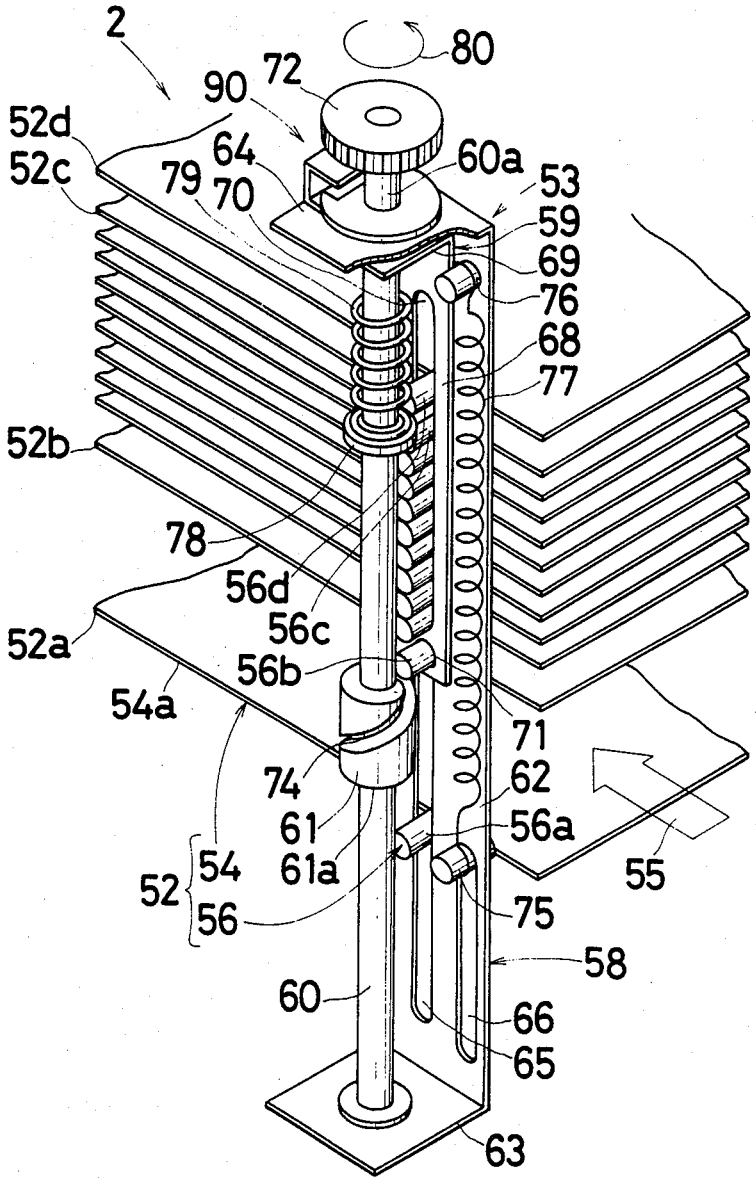
FIG. 3 is a perspective illustration of the sorter in FIG. 2.

FIG. 2 is a front elevational view showing on an enlarged scale the main construction of the sorter 2 as illustrated in FIG. 1, while FIG. 3 is a perspective view of the arrangement of FIG. 2. The respective bins 52 are arranged with spaces therebetween in the vertical direction. Each of the bins 52 includes a flat plate-like tray 54. Cylindrical projections 56 project outwardly from opposite sides of the tray 54 in the widthwise direction at right angles to a direction 55 of discharging the copy paper sheets 6, 7 through the set of discharge rollers 37. The projections 56 are provided at the upstream side, in the discharge direction 55, of the tray 54. The edge portion of each tray 54 at the downstream side, in the discharge direction 55, is placed on a suppport shaft 57 provided for each of the bins 52. Each support shaft 57 has a horizontal axis directed at right angles with respect to the discharge direction 55, whereby the angular positions of the bins 52 about the respective support shafts 57 may be altered, and also the bins may be moved in the discharge direction 55. Therefore, the bins 52 are movable generally in the upward and downward directions.

The shifting means 53 includes a frame 58, a guide piece 59, a rotary shaft 60 and a cylindrical cam 61. The frame 58 comprises a flat plate-like vertical portion 62 and horizontal portions 63 and 64 secured to or integrally formed with opposite ends of the vertical portion 62 in directions at right angles with respect thereto. A first elongated opening 65 extends vertically over approximately the entire length of the vertical portion 62, and a second elongated opening 66 extends parallel to the first elongated opening 65. The upper end of the second elongated opening 66 is located at a position lower than the leading edges of the copy paper sheets 6, 7 as shown in FIG. 2.

Meanwhile, the guide piece 59 disposed in the frame 58 includes a vertical portion 68 slidably contacting with the vertical portion 62 of the frame 58, and a horizontal portion 69 secured at right angles to the upper end of vertical portion 68. In the vertical portion 68 is formed an elongated opening 79 which is communicated with and extends parallel to the first elongated opening 65 of the frame 58. Moreover, in the vertical portion 68 is formed a through-opening 71 which is communicated with the first elongated opening 65 and located at a position immediately below the lower end of the elongated opening 70. It is to be noted here that the length of the vertical portion 68 of the guide piece 59 is selected to be shorter than the total length of the vertical portion 62 of the frame 58.

The rotary shaft 60 extending in parallel relation along the vertical portion 62 is rotatably supported by the horizontal portions 63 and 64 of the frame 58 about a vertical axis. At a top portion 60*a* of rotary shaft 60 extending upwardly from the horizontal portion 64 of the frame 58 is fixed a gear 72 for transmitting rotational driving force from a rotating driving means 153 (FIG. 9) such as a stepping motor or the like to the rotary shaft 60. It is to be noted that the rotary shaft 60 extends through the horizontal portion 69 of the guide piece 59 so as to be allowed to rotate about the vertical axis.

The cylindrical cam 61 is fixed to the rotary shaft 60 at a position corresponding to the paper discharge position 73 for the copy paper sheets 6, 7 to be discharged through the discharge rollers 37. This cylindrical cam 61 has the same axis as the rotary axis of the rotary shaft 60. On the outer peripheral surface of cylindrical cam 61 is formed a track groove 74 for guiding the projections 56 of the bins 52 for upward and downward movements. It is to be noted that the lower end face 61*a* of the cylindrical cam 61 is located in a position higher than the upper end portion of the second elongated opening 66 of the frame 58.

The projections 56*a* of the bin 52*a* located at the lowest position is loosely received in the first elongated opening 65 of the frame 58. On the tray 54*a* of the bin 52*a*, there is fixed a projection 75 which is loosely fitted into the second elongated opening 66 of the frame 58. An end of a spring member 77 is connected with projection 75 and the other end of the spring member 77 is connected with a projection 76 secured in a position at the top of the frame 58. The spring member 77 urges the projections 75 and 76 in a direction toward each other, and thus, the bin 52*a* is biased upwardly by spring member 77. It should be noted that the bin 52*a* is prevented from being displaced to a position higher than the paper discharge position 73 of the copy paper sheets 6, 7 by the engagement of the projection 75 with the corresponding upper end of the second elongated opening 66.

Figure 6:
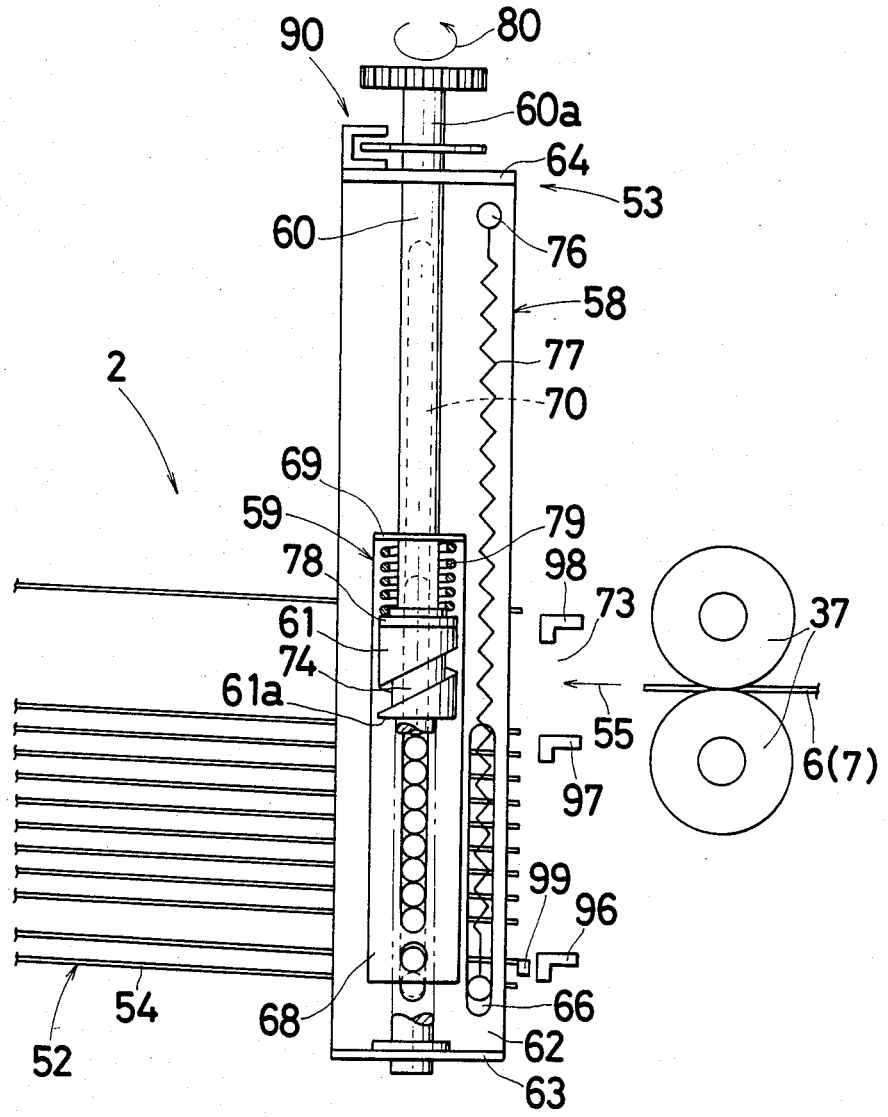
FIGS. 6 and 7 are front elevational views showing other operating conditions of the sorter.

The projection 56*b* of the bin 52*b* located at the second lowest position is inserted through the first elongated opening 65 of the frame 58 and the through-opening 71 of the guide piece 59. Projections 56 of the remaining bins, except for the bins 52*a* and 52*b*, are respectively inserted through the first elongated opening 65 of the frame 58 and the elongated opening 70 of the guide piece 59. Between projections 56*d* and 56*c* of a cover 52*d* located above the bins 52 and a bin 52*c* located at the uppermost position of the bins 52, is interposed a disc 78 loosely fitted over the rotary shaft 60 and vertically movable along the rotating axis of the rotary shaft 60. Between the disc 78 and the horizontal portion 69 of the guide piece 59 is provided a spiral spring member 79 surrounding the rotary shaft 60. When all of the bins 52 are shifted downwards (the state as shown in FIG. 6), the bins 52 are urged upwardly by the spring member 79.

In FIGS. 2 and 3, although the shifting means 53 is illustrated for brevity as provided at one side edge of the bins 52, in the widthwise direction at right angles with the paper discharge direction 55, it is to be noted that another shifting means having a similar construction is provided at the opposite side edge of the bins in the widthwise direction.

In the sorter 2 having the construction as described above, every time the rotary shaft 60 is rotated for one rotation by the rotating drive means 153 (FIG. 9), the projection 56 of one bin 52 is displaced by the track groove 74 of the cylindrical cam 61, whereby the respective bins 52 are shifted, one by one, in the vertical direction to confront the paper discharge position 73. In the above case, the copy paper sheets 6, 7 discharged by the discharge rollers 37 are sorted or supplied into the respective bins 52. It is to be noted that the respective bins 52 are moved downwards when the rotating drive means 153 (FIG. 9) is rotated in a forward direction for rotating the rotary shaft 60 in the direction of an arrow 80, while they are shifted upward by reverse rotation of the rotating drive means 153 (FIG. 9) for rotation of rotary shaft 60 in a direction opposite to the direction indicated by the arrow 80.

Referring back to FIG. 1, within a housing 3 of the copying apparatus, there are provided detection switches 81 and 82 respectively above the cassettes 4 and 5 at the right side of the housing 3 for detecting whether or not the copy paper sheets 6, 7 are present in cassettes 4 and 5. Meanwhile, at the upper left side in the housing 3, there is also provided a detection switch 83 for detecting the reciprocation of the optical device 17, i.e. the completion of one copying operation of the copying machine. In the vicinity of the discharge rollers 37, another detection switch 84 is provided for detection of the copy paper sheets discharged by the discharge rollers 37. Moreover, in a position close to the heating and fixing device 33 disposed at the left lower portion in the housing 3, a temperature detection unit 85 is provided for detecting that the heating and fixing device 33 has reached a temperature sufficient to effect heat fixing. Furthermore, in the housing 3 of the copying apparatus main body 1, a control means 87 is disposed for controlling the copying function of the copying apparatus main body 1. Additionally, in the neighborhood of the cassettes 4 and 5, there are respectively provided detection switches 86*a* and 86*b* for detecting that the copy paper sheets 6, 7 are fed from the cassettes 4 and 5 when such feeding is effected. By measuring the time elapsing from the time when detection is made by the detection switches 86*a* and 86*b* up to the time when trailing edges of the copy paper sheets 6, 7 are detected by the detection switch 84, detection is effected as to whether or not jamming of the copy paper sheets 6 and 7 has taken place within the copying apparatus main body 1.

Figure 4:
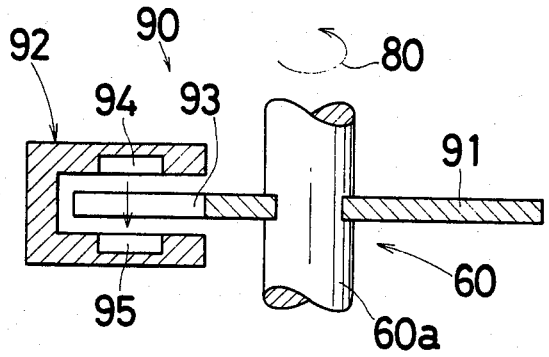
FIG. 4 is a vertical cross-sectional view of a detecting means of FIGS. 2 and 3.

Referring back also to FIGS. 2 and 3, in the projecting portion 60*a* of the rotary shaft 60, in a position between the horizontal portion 64 of the frame 58 and the gear 72, there is provided a detecting means 90 for detecting whether or not the upper end of the track groove 74 of the cylindrical cam 61 is located at a predetermined position along the circumferential direction of the rotary shaft 60. The predetermined position as referred to above is a rotation starting position for one rotation of the cylindrical cam 61 around the axis of the rotary shaft 60, and corresponds to the position at which the cylindrical cam 61 is in a stationary or starting position. Referring to FIG. 4, the detecting means 90 includes a disc portion 91 secured to the rotary shaft 60 for rotation around the rotating axis of rotary shaft 60, and a detecting portion 92 fixed to the frame 58. The disc portion 91 is formed with a notched window 93. Meanwhile, the detecting portion 92 is provided with a light emitting element 94 and a light receiving element 95 disposed to confront each other, with the disc portion 91 located therebetween. As shown in FIG. 4, when the notched window 93 of the disc portion 91 is located between the light emitting element 94 and the light receiving element 95, i.e. when the cylindrical cam 61 is located in the stationary position, light from the light emitting element 94 is received by the light receiving element 95, whereby the detecting portion 92 produces a high level signal as described later.

Figure 5:
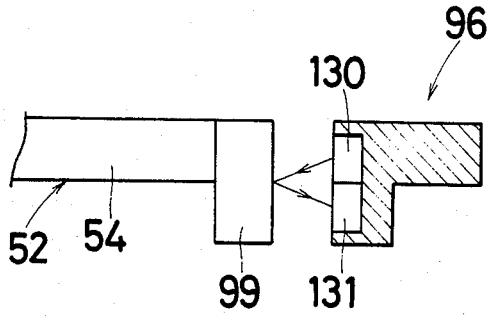
FIG. 5 is a vertical cross-sectional view of a detector of FIG. 2.

Within the sorter 2, there are provided detectors 96, 97 and 98 for detecting the shifting positions of the predetermined bin 52*b* (FIG. 6). On the end face at the upstream side, with respect to the direction for 55, of the bin 52*b* there is fixedly provided a reflecting member 99. The respective detectors 96 to 98 are disposed along the moving direction of the reflecting member 99 corresponding to the movement of bin 52*b*. Referring further to FIG. 5, the detector 96 is provided with a light emitting element 130 and a light receiving element 131 which are disposed adjacent to each other. When the reflecting member 99 is located at a position confronting the light emitting element 130 and light receiving element 131 as shown in FIG. 5, light from the light emitting element 130 is reflected by the reflecting member 99 and directed to the light receiving element 131. In the above case, the detector 96 provides a high level signal. It is to be noted that the detectors 97 and 98 have constructions similar to that of the detector 96.

Figure 7:
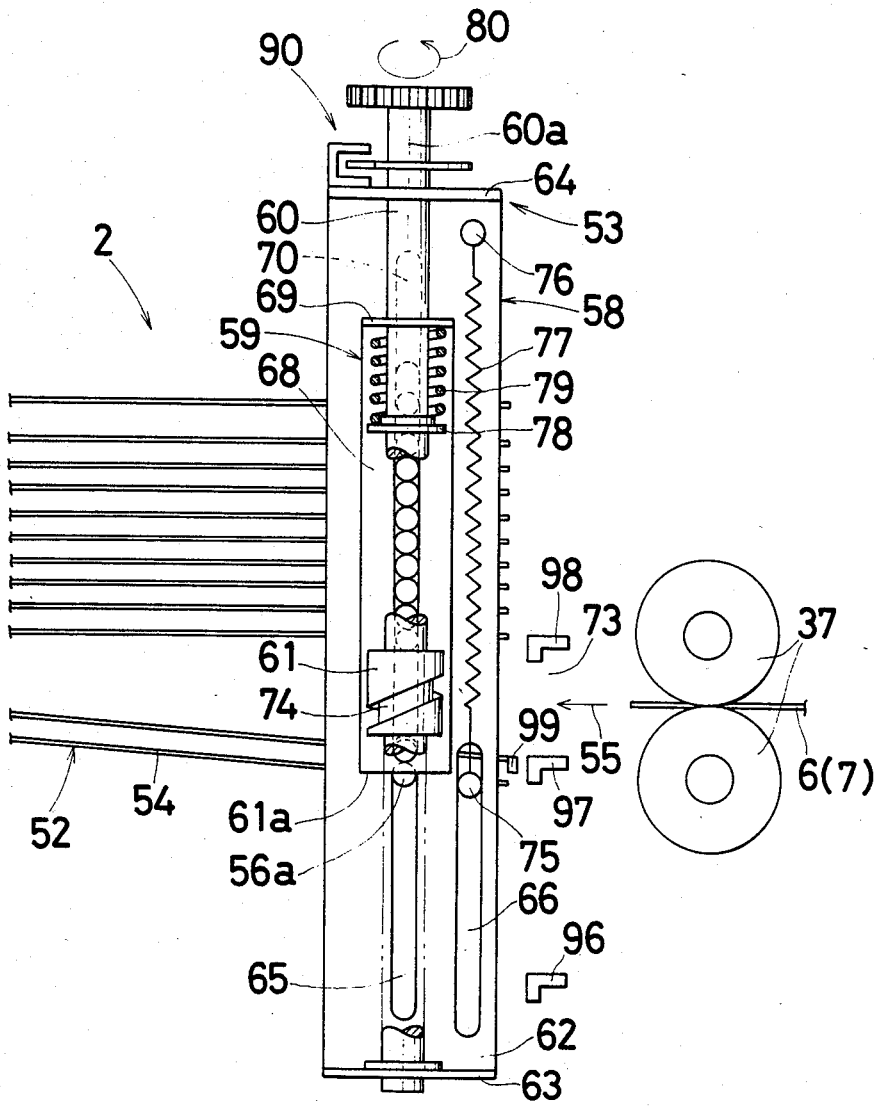

The position where the detector 96 is disposed corresponds to a position to which the bin 52*b* moves when the uppermost bin 52*c* has been shifted to confront the paper discharge position 73. Accordingly, the time when the high level signal is derived from the detector 96 is the time at which all of the bins 52 which can be guided by the cylindrical cam 61 are shifted downwards. As shown in FIG. 7, the position where the detector 97 is disposed corresponds to the position at which the bin 52*b* is detected when the bin 52*b* has been shifted to confront the paper discharge position 73. Therefore, when a high level signal is derived from the detector 97, the sorter 2 has reached the state suitable for starting the sort mode function as explained with reference to FIG. 1. Meanwhile, as shown in FIGS. 2 and 3, the position where the detector 98 is disposed corresponds to a position where the bin 52*b* is detected when the bin 52*a* is shifted to confront the paper discharge position 73. Accordingly, when a high level signal is derived from the detector 98, the sorter 2 has been brought into the state capable of effecting the non-sort mode function as described with reference to FIG. 1.

Figure 8:
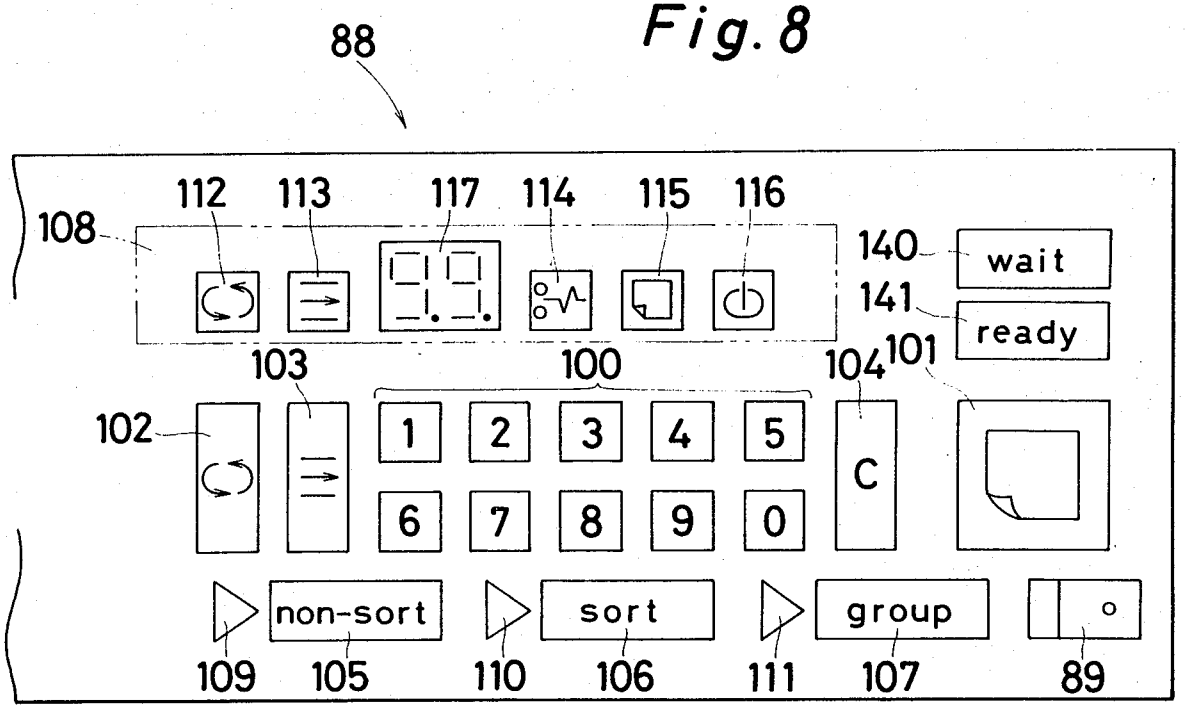
FIG. 8 is a top plan view illustrating a part of a control section of the electrostatic copying apparatus of the present invention.

Referring to FIG. 8, there is shown a top plan view illustrating a part of a control section 88 of the electrostatic copying apparatus to which the present invention may be applied. The control section 88 is provided, for example, at the top of the housing 3 of the copying apparatus main body 1. The control section 88 includes a power switch 89, ten keys 100, a print button 101, a memory key 102, an interruption key 103, a clear key 104, a non-sort key 105, a sort key 106, a group key 107, a display portion 108, and indicators 109 to 111, and 140 and 141. The ten keys 100 are for setting the number of copies to be made, and respectively are indicated on their surfaces with numerals from 0 to 9. The print button 101 is operated through depression for starting a copying operation. The memory key 102 is actuated through depression, during copying of the same number of sheets of a plurality of original documents, for memorizing the number of copies initially set, up to the completion of copying of such original documents. The interruption key 103 is operated through depression for copying another original document during and by interrupting the course of copying of a plurality of sheets of a single original document. The clear key 104 is depressed for clearing the number of sheets to be copied which is set by the ten keys 100. The non-sort key 105 is depressed for operation when it is not required to particularly classify the plurality of copied paper sheets discharged from the copying apparatus main body 1 by the use of the sorter 2, i.e. when the sorter 2 is to be operated in the non-sort mode. The sort key 106 is depressed when the plurality of copy paper sheets discharged from the copying apparatus main body 1 are classified one sheet by one sheet by the use of the sorter 2, i.e. when the sorter 2 is to be operated in the sort mode. Meanwhile, the group key 107 is operated through depression when the plurality of copy paper sheets discharged from the copying apparatus main body 1 are to be classified per a plurality of sheets with the use of the sorter 2, i.e. when the sorter 2 is operated by the group mode.

The display portion 108 includes a plurality of indicators 112 to 116 having symbols and letters for abbreviations indicated on their surfaces, and another indicator 117 composed of seven segments. The indicator 112 is lit simultaneously with the depression of the memory key 102 so as to indicate that the memory key 102 has been depressed for actuation. The indicator 113 is lit upon depression of the interruption key 103 to indicate that the interruption key 103 has been depressed. The indicator 117 is lit upon depression of the ten keys 100 so as to indicate the set number of copies to be made, for example, by figures in two digits. The indicator 114 is illuminated when the occurrence of jamming of the copy paper sheets 6, 7 is detected by the detection switches 86*a*, 86*b* and 84. The indicator 115 is lit when the detection switches 81 and 82 detect that the copy paper sheets 6, 7 are not present within the cassettes 4 and 5. The indicator 116 is illuminated immediately after turning on power switch 89, and goes out upon detection by the temperature detecting unit 85 that the heating and fixing device 33 has reached a temperature sufficient for effecting heat fixing so as to indicate that the operation of the copying apparatus has become possible.

The indicator 109 is illuminated through depression of the non-sort key 105 so as to indicate that the sorter 2 carries out the non-sort mode function. The indicator 110 is lit by the depression of the sort key 106 for indicating that the sorter 2 effects the sort mode function. The indicator 111 is illuminated by the depression of the group key 107 to show that the sorter 2 performs the group mode function. The indicator 140 is arranged to be lit when the non-sort key 105, sort key 106 or group key 107 are depressed for actuation and the bins 52 are shifted other than when they are moved for sorting the copy paper sheets, and to go out when the bins 52 are stopped. The indicator 141 is lit at the same time that the indicator 140 goes out. In other words, the indicator 140 indicates that a copying operation is prohibited during movement of the bins 52 other than when the copy paper sheets are to be accommodated in the bins 52, while the indicator 141 indicates that the shifting of the bins 52 has been stopped and a copying operation has become possible when such a state has been reached.

Figure 9:
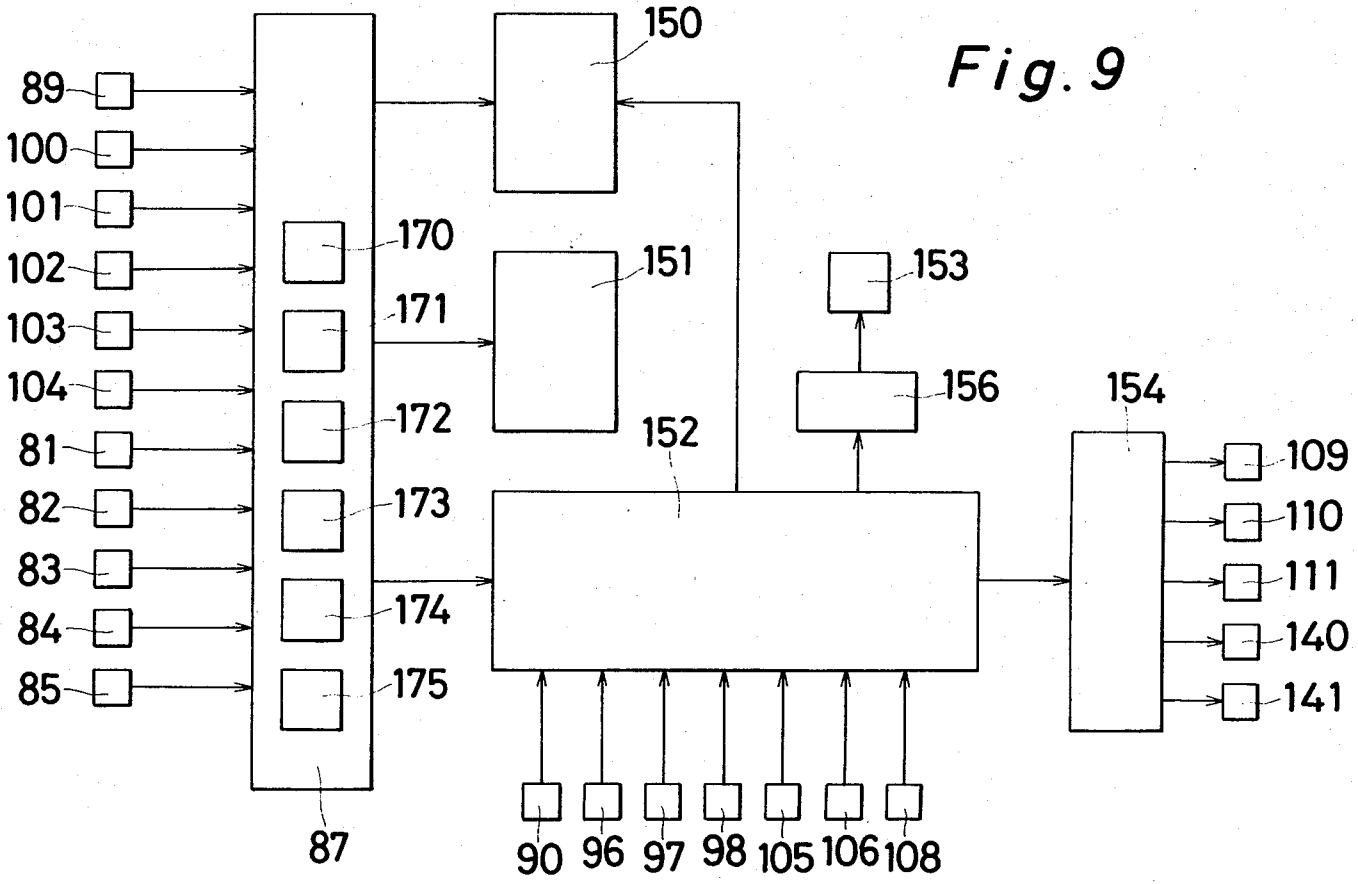
FIG. 9 is a block diagram related to a control means in FIG. 1.

Reference is further made to FIG. 9 showing a block diagram of the control means 87. To the control means 87 are input signals generated through depression of the power switch 89, ten keys 100, print button 101, memory key 102, interruption key 103, and clear key 104 for the control section 88. Moreover, the detection output signals of the detection switches 81 to 84 and the temperature detecting unit 85 are also applied to the control means 87. In response to these input signals the control means 87 controls driving of the optical device 17, photosensitive drum 23, feeding rollers 8 and 9, and other rollers described with reference to FIG. 1 through a driving means 150. Moreover, the control means 87 illuminates and drives the display portion 108 of the control section 88 described with reference to FIG. 8 through a driving means 151. Furthermore, the control means 87 imparts signals required for the control of the sorter 2 to an electrical circuit 152 for controlling the functioning of the sorter 2.

In association with the necessary signals as described above to be applied to the electrical circuit 152, the control means 87 is provided with a signal generating circuit 170, a first counter 171, a second counter 172, a first memory 173, a second memory 174 and a third memory 175. The signal generating circuit 170 functions to derive high level signals through detection that the respective keys 100, 102, 103, and 104, and also the print button 101 are not depressed even after lapse of a predetermined period of time subsequent to completion of a copying operation in the copying apparatus main body 1, if such keys and button are not depressed. The first counter 171 functions to count the number of sheets copied by signals applied from the detection switch 83 to the control means 87. The second counter 172 functions to count the number of copy paper sheets 6 and 7 discharged from the copying apparatus main body 1 by signals input from the detection switch 84 to the control means 87. The first memory 173 memorizes the number of sheets preliminarily set by the keys 100. The second memory 174 memorizes the counted value in the first counter 171, i.e. the number of copied sheets. The third memory 175 functions, when interruption of copying is effected by the depression of the interruption key 103, to memorize the remaining number of copies to be made for the initial copying operation. It is to be noted here that in the interruption copying as described above, the preliminarily set number of copies to be made by the interruption corresponding to the original document to be subjected to the interruption copying, is memorized in the first memory 173. The control means 87 stops the copying operation upon coincidence of the count value in the first counter 171 with the contents memorized in the first memory 173, and also derives a high level signal as one signal of a plurality of signals to be applied to the electrical circuit 152, upon agreement of the count value in the second counter 172 with the contents memorized in the first memory 173.

To the electrical circuit 152 are supplied, besides the signal to be applied from the control means 87, the signal from the detecting portion 92 of the detecting means 90, the signals from the detectors 96, 97 and 98, and the signals produced by the depression of the non-sort key 105, sort key 106, and group key 107. In response to such applied signals, the electrical circuit 152 drives, through a drive means 156, the rotating drive means 153 for driving the rotary shaft 60 and also causes, through a drive means 154, the indicators 109 to 111 and indicators 140 and 141 to be illuminated.

Figure 10A:
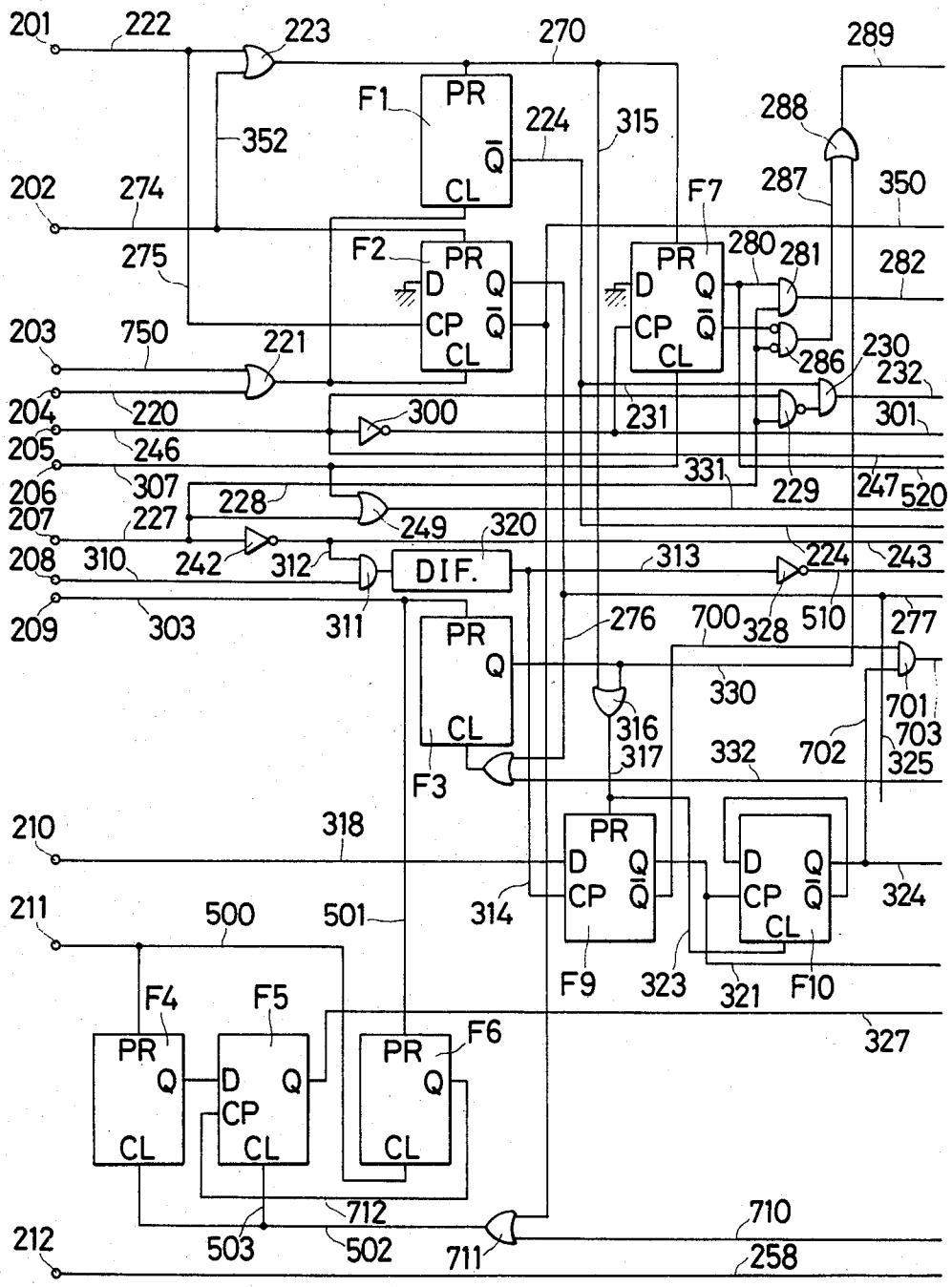
FIGS. 10(*a*) and (*b*) are specific circuit diagrams of an electrical circuit as illustrated in FIG. 9.
Figure 10B:
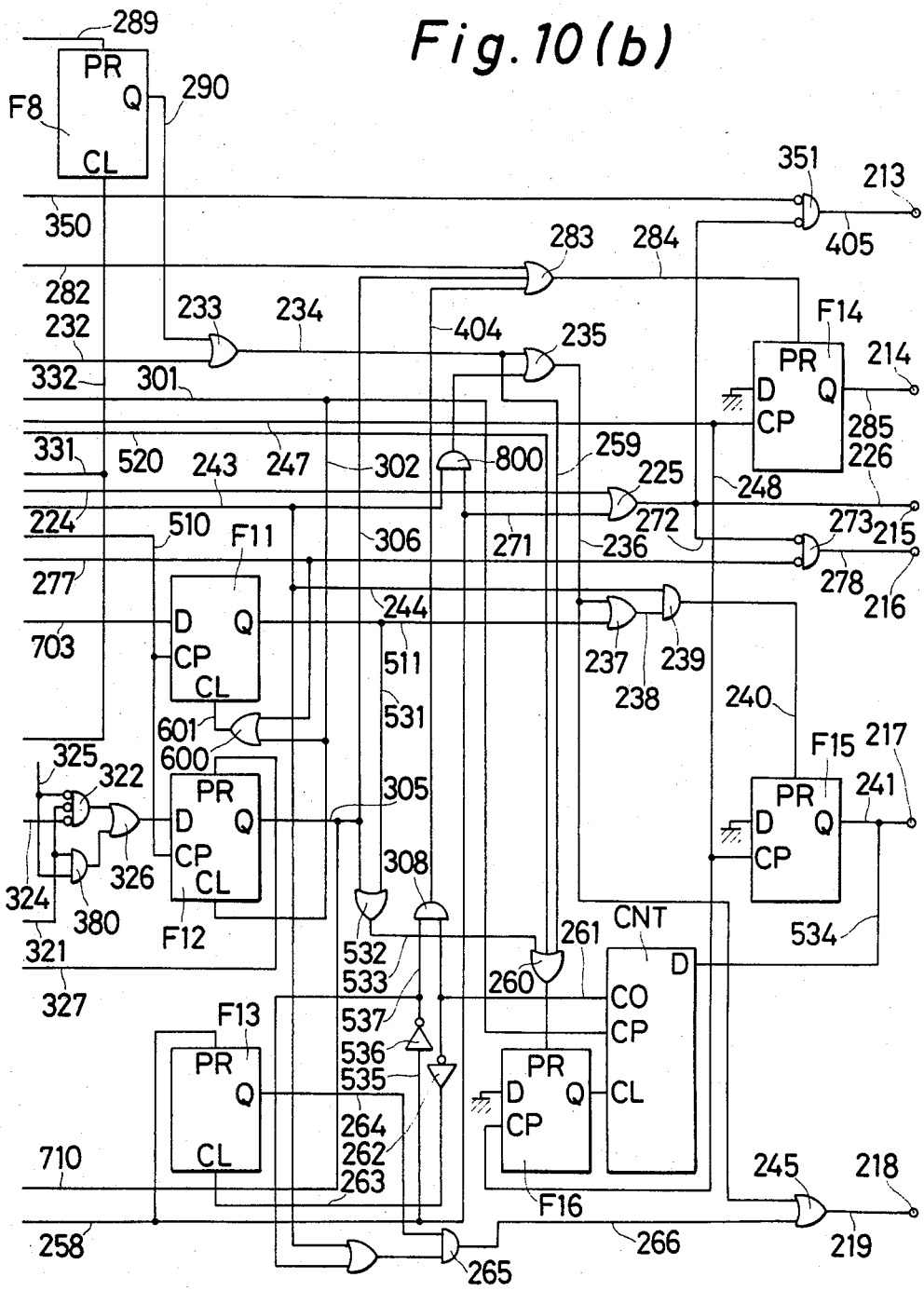

In FIG. 10 (a) and (b), there is shown a specific circuit diagram of the electrical circuit 152 illustrated in FIG. 9. The electrical circuit 152 includes input terminals 201 to 212, output terminals 213 to 218, flip-flops F1 to F16, and a counter CNT. To the input terminal 201, pulse signal of high level upon depression of the sort key 106 and a signal of low level when the key 106 is not depressed. To the input terminal 202, a pulse signal of high level is impressed upon depression of the group key 107, and a signal of low level is applied when the group key 107 is not depressed. To the input terminal 203, a signal from the signal generating circuit 170 of the control means 87 is applied. Meanwhile, to the input terminal 204, a pulse signal of high level is applied upon depression of the non-sort key 105, and a signal of low level is applied when key 105 is not depressed. To the input terminal 205, a signal from the detecting portion 92 of the detecting means 90 is applied. To the input terminal 206, a signal from the detector 97 is impressed. More specifically, when the bin 52*b* located at the second lowest position is detected by the detector 97, a signal of high level is applied from the detector 97 to the input terminal 206, and if bin 52*b* is not detected, a signal of low level from the detector 97 is applied to input terminal 206. To the input terminal 207, a signal from the detector 98 is impressed. In other words, when the bin 52*b* located at the second lowest position is detected by the detector 98, a signal of high level is applied from the detector 98 to the input terminal 207, and if bin 52*b* is not detected, a signal of low level is applied thereto. To the input terminal 208, a pulse signal of high level is applied from the control means 87 upon detection of the copy paper sheets 6, 7 discharged from the copying apparatus main body 1 by the detection switch 84. To the input terminal 209, a pulse signal of high level is applied through the control means 87 when the preliminarily set number of copies to be made through depression of the clear key 104 and/or keys 100, is altered. Moreover, to the input terminal 209, such pulse signal is applied after the copy paper sheets 6, 7 have been discharged from the copying apparatus main body 1, while when the copying apparatus main body 1 is subjected to an interruption copying operation through depression of the interruption key 103, a signal of low level remains applied thereto. To the input terminal 210, a signal of high level is applied through the control means 87, when the count value of the second counter 172 of the control means 87 coincides with the contents memorized in the first memory 173, i.e. when the number of copy paper sheets 6, 7 discharged from the copying apparatus main body 1 agrees with the preliminarily set number of copies to be made, while in the other states, a signal of low level is applied thereto through the control means 87. To the input terminal 211, a signal of high level is applied when the copying apparatus main body 1 is in the copying function through depression of the print button 101, and a signal of low level is applied thereto upon completion of the copying operation by the copying apparatus main body 1. It is also to be noted that, to the input terminal 211, a signal of low level is impressed when the copying apparatus main body 1 is in the interruption copying function through depression of the interruption key 103. Meanwhile, to the input terminal 212, a signal of high level is applied through the control means 87 when the copying apparatus main body 1 is in the interruption copying function through depression of the interruption key 103, while a signal of low level is applied thereto through the control means 87 when the copying apparatus main body 1 is effecting the normal copying operation without performing interruption copying.

The signal produced from the output terminal 213 is applied to the driving means 154, which illuminates and drives the indicator 111 when the signal output from the output terminal 213 is of high level. The signal produced from the output terminal 214 is applied to the driving means 156. The driving means 156 causes the rotating drive means 153 to rotate in a forward direction when the signal output from the output terminal 214 is of high level. The signal produced from the output terminal 215 is applied to the driving means 154, which illuminates and drives the indicator 109 when the signal produced from the output terminal 215 is of high level. Meanwhile, the signal produced from the output terminal 216 is also applied to the driving means 154, which illuminates and drives the indicator 110 when the signal produced from the output terminal 216 is of high level. The signal output from the output terminal 217 is applied to the driving means 156, which causes the rotating drive means 153 to rotate in a reverse direction, when the signal produced from the output terminal 217 is of high level. The signal produced from the output terminal 218 is applied to the driving means 150 and driving means 154. The driving means 150 is prevented from driving the optical system 17, photoreceptor drum 23, paper feeding rollers 8 and 9 and other rollers, when the signal produced from the output terminal 218 is of high level. Meanwhile, the driving means 154 illuminates and drives the indicator 140, when the signal produced from the output terminal 218 is of high level, while driving means 154 illuminates and drives the indicator 141 when the signal is of low level.

The flip-flops F1 to F16 are so-called delayed flip-flops and produce signals of high level or low level from respective output terminals Q, and $\overline{Q}$, in response to the signals applied to corresponding input terminals D, CP, PR and CL. The contents of functions of such flip-flops F1 to F16 are tabulated in a list of truth table in Table 1 given below.

TABLE 1

| Input terminal | | | | Output terminal | |
|---|---|---|---|---|---|
| PR | CL | D | CP | Q | $\overline{Q}$ |
| L | L | H | ↑ | H | L |
| L | L | L | ↑ | L | H |
| L | L | * | ↓ | No change | |
| L | H | * | * | L | H |
| H | L | * | * | H | L |
| H | H | * | * | L | H |

In Table 1, the symbol H represents signals of high level, symbol L shows signals of low level, symbol ↑ denotes rising waveform of signals, symbol ↓ represents falling waveform of signals, and symbol * indicates that the signal may be of high level or of low level.

The counter CNT is provided with a data input terminal D, a clear input terminal CL, a clock pulse input terminal CP and an output terminal CO, and is arranged to count through addition the number of pulse signals applied to the clock pulse input terminal CP when the signal applied to the data input terminal D is of high level, while the counter CNT has another function to count the number of pulse signals, when the signal applied to the data input terminal D is of low level, through subtraction of the number of pulse signals input to the clock pulse input terminal CP from the count value by the counter CNT at that time. The counter CNT produces signals of high level from the output terminal CO thereof, when the counted value is larger than 0, and outputs signals of low level when the counted value is 0, while counter CNT functions to cancel the counted value, i.e. to render the counted value 0, when a signal of high level is applied to the clear input terminal CL.

By the signals input and output in the manner as described so far, the electrical circuit 152 controls the respective mode functions in the sorter 2, i.e. (A) non-sort mode, (B) sort mode, and (C) group mode.

Hereinbelow, functionings of the electrical circuit 152 following the respective mode functions of the sorter 2 will be explained step by step.

(A) Non-sort mode

STEP (1*a*): Non-sort mode indication

When it is not required to classify the plurality of copy paper sheets 6, 7 discharged from the copying apparatus main body 1 by the use of the sorter 2, the non-sort key 105 is depressed, whereby a pulse signal of high level is applied to the input terminal 204. This pulse signal is applied to the input terminal of an OR gate 221 through a line 220. The pulse signal of high level produced from the OR gate 221 is impressed to the clear input terminal CL of the flip-flop F1, whereby the flip-flop F1 is reset to produce a signal of high level from a reset output terminal $\overline{Q}$. This high level signal is applied to the output terminal 215 through a line 224, an OR gate 225 and a line 226. Accordingly, the signal applied to the output terminal 215 becomes high level, and thus, the indicator 109 is illuminated and driven through the driving means 154 to indicate that the sorter 2 is in the state to function in by the non-sort mode.

STEP (2*a*): Positional change-over of the bins 52

When the sorter 2 is operated in the non-sort mode, the copy paper sheets 6, 7 discharged from the copying apparatus main body 1 are supplied into the predetermined bin 52*a* for the non-sort mode. Accordingly, when the sorter 2 starts the non-sort mode function, if the bin 52*a* is not located at the paper discharge position 73 (i.e. the state shown in FIG. 2), it is necessary to move the bin 52*a* to paper discharge position 73.

In the case where the bin 52*a* is not in the state where it has been shifted to the paper discharge position 73 (i.e. the state shown in FIG. 2), the bin 52*b* is not detected by the detector 98, and therefore, the signal applied to the input terminal 207 from the detector 98 is low level. This low level signal is applied to one input terminal of a NAND gate 229 through lines 227 and 228. Accordingly, a signal of high level is produced from the NAND gate 229 so as to be applied to one input terminal of an AND gate 230. In this case, the flip-flop F1 is in the reset state, since the pulse signal of high level from the OR gate 221 is applied to the clear input terminal CL, with a signal of high level being output from the reset output terminal $\overline{Q}$, and this high level signal is applied to the other input terminal of the AND gate 230 through the lines 224 and 231. Therefore, a signal of high level is produced from the AND gate 230. This signal of high level is applied to one input terminal of an AND gate 239 through a line 232, an OR gate 233, a line 234, an OR gate 235, a line 236, an OR gate 237, and a line 238. In this case, a signal of low level is applied to the input terminal 207, and this low level signal is applied to an inverter 242 through a line 227. Therefore, a signal of high level is produced from the inverter 242, and this high level signal is impressed to the other input terminal of the AND gate 239 through lines 243 and 244, whereby a signal of high level is produced from the AND gate 239, and this high level signal is applied to a preset input terminal PR of the flip-flop F15 through a line 240. As a result, the flip-flop F15 is set, and from the set output terminal Q, a signal of high level is produced, and this high level signal is impressed to the output terminal 217 through a line 241. Therefore, the rotating drive means 153 is subjected to reverse rotation through the driving means 156, with a consequent upward shifting of the bins 52. In the above case, the flip-flop f15 remains set as stated previously, and the bins 52 are continuously shifted until the bin 52*a* is located at the position confronting the paper discharge position 73.

STEP (3*a*): Prohibition of copying

During movement of the bins 52, the signal applied to the input terminal 207 remains low level, with the flip-flop F1 remaining in the reset state, and the signal produced from the reset output terminal $\overline{Q}$ also remains high level. Accordingly, the signal output from the AND gate 230 remains high level. Therefore, the signal derived into the line 236 is also of high level, and this signal of high level is applied from an OR gate 245 to output terminal 218 through a line 219. Thus, the signal being applied to the output terminal 218 is of high level. Accordingly, the driving means 150 is prevented from driving the optical device 17, photosensitive drum 23, feeding rollers 8 and the other rollers. Therefore, in the course of movement of the bins 52 in the case other than when bins 52 are shifted for sorting the copy paper sheets 6, 7 discharged from the copying apparatus main body 1, main body 1 does not carry out a copying operation even if the print button 101 is depressed for actuation by mistake. Accordingly, the copy paper sheets 6, 7 are not discharged from the copying apparatus main body 1, and thus the occurrence of paper jamming, etc. within the sorter 2 is advantageously prevented. Meanwhile, when the signal produced from the output terminal 218 is of high level, the driving means 154 illuminates the indicator 140 for indication of prohibition of copying to the operator.

STEP (4*a*): Suspension of shifting for positional change-over of the bins 52

Upon upward shifting of the bins 52, when the bin 52*a* is moved to a position confronting the paper discharge position 73, the signal applied from the detector 98 to the input terminal 207 is high level. Accordingly, the signal applied from the line 227 to the inverter 242 becomes high level, while the signal output from the inverter 242 is low level. This signal of low level is applied to one input terminal of the AND gate 239 through the lines 243 and 244. Therefore, the signal produced from the AND gate 239 becomes low level. Thus, the signal applied to a preset input terminal PR of the flip-flop F15 becomes low level. During movement of the bins 52, since the rotary shaft 60 is rotated by the rotating drive means 153, a pulse signal is applied to the input terminal 205. This pulse signal is impressed on a clock pulse input terminal CP of the flip-flop F15 through lines 246, 247 and 248. Therefore, the flip-flop F15 is released from the set state in response to rising waveform of the pulse signal, and simultaneously, produces a signal of low level applied to a data input terminal D from the set output terminal Q. This low level signal is applied to the output terminal 217 through the line 241. Accordingly, driving of the rotating drive means 153 is suspended through the driving means 156, and consequently, shifting of the bins 52 is suspended. In the manner as described above, when the bin 52*a* for the non-sort mode has been shifted to the position confronting the paper discharge position 73, the shifting of the bins 52 is stopped.

STEP (5*a*): Releasing from prohibition of copying

When the bin 52*a* has been shifted to the position confronting the paper discharge position 73 in the above described manner, a signal of high level is applied to the input terminal 207. This high level signal is impressed on one input terminal of the NAND gate 229 through the lines 227 and 228. Additionally, the signal applied to the input terminal 205 in this case is also of high level. Accordingly, a signal of low level is produced from the NAND gate 229, and this low level signal is impressed on one input terminal of the AND gate 230. Therefore, the signal output from the AND gate 230 becomes low level. This signal of low level is applied to one input terminal of the OR gate 233 through the line 232.

On the other hand, the high level signal applied to the input terminal 207 is applied, through the line 227, to one input terminal of an OR gate 249, and thus, a signal of high level is produced from the OR gate 249, and this high level signal is applied to a clear input terminal CL of a flip-flop F8. Therefore, the flip-flop F8 is reset, and a signal of low level is produced from the set output terminal Q of the flip-flop F8. This low level signal is further impressed on the other input terminal of the OR gate 233.

By the above function, a signal of low level is output from the OR gate 233, and this low level signal is impressed on one input terminal of the OR gate 235. In the above case, since the interruption key 103 is not depressed for actuation, a signal of low level is applied to the input terminal 212. This low level signal is impressed on the other input terminal of the OR gate 235 through a line 258 and an AND gate 800. Accordingly, a signal of low level is produced from the OR gate 235, and this low level signal is further impressed on one input terminal of the OR gate 245 through the line 236.

As explained with reference to the STEP (2*a*), during the shifting of the bins 52, the signal derived at the line 234 is of high level, and this high level signal is applied to an OR gate 260 through a line 259 which branches off from the line 234. Therefore, the signal produced from the OR gate 260 is of high level, and this high level signal is impressed on a preset input terminal PR of the flip-flop F16. Therefore, the flip-flop F16 is set and produces a signal of high level from the set output terminal Q. This high level signal is impressed on the clear input terminal CL of the counter CNT. Accordingly, the count value of the counter CNT is brought into a state of "0". Under the state of the counter as described above, the situation is the same even immediately after the bins 52 stop shifting as described in the STEP (4*a*), and therefore, a signal of low level is produced from the output terminal CO of the counter CNT. This low level signal is applied to an inverter 262 through a line 261, and a signal of high level is produced from the inverter 262. This high level signal is impressed on the clear input terminal CL of the flip-flop F13 through the line 263. Accordingly, the flip-flop F13 is reset to a produce signal of low level from the set output terminal Q. This low level signal is applied to one input terminal of an AND gate 265 through a line 264. Therefore, a signal of low level is output from the AND gate 265, and this low level signal is impressed on the other input terminal of the OR gate 245 through a line 266.

Accordingly, the signal produced from the OR gate 245 becomes low level, and thus, the signal applied to the output terminal 218 is also low level. Therefore, it becomes possible for the driving means 150 to drive the optical device 17, photosensitive drum 23, feeding rollers 8 and 9 and the other rollers. Meanwhile, the driving means 154 illuminates and drives the indicator 141, and thus, the operator is notified that copying has become possible.

As described so far, in the non-sort mode function of the sorter 2, the bin 52*a* for the non-sort mode preliminarily selected in the bins 52 is shifted to confront the paper discharge position 73, and the copy paper sheets 6, 7 discharged from the copying apparatus main body 1 are supplied into the bin 52*a*.

(B) Sort mode

STEP (1*b*): Sort mode indication

For sorting the plurality of copy paper sheets 6, 7 discharged from the copying apparatus main body 1, one sheet into each of a plurality of the bins, with the use of the sorter 2, the sort key 106 is depressed for actuation, whereby a pulse signal of high level is applied to the input terminal 201. This pulse signal of high level is impressed on a preset input terminal PR of the flip-flop F1 through the line 222, OR gate 223 and line 270, whereby the flip-flop F1 is set, and a signal of low level is output from the reset output terminal $\overline{Q}$. This low level signal is applied to one input terminal of the OR gate 225 through the line 224. In this case, the signal being applied to the input terminal 212 is of low level, and this low level signal is applied to the other input terminal of the OR gate 225 through lines 258 and 271, whereby a signal of low level is produced from the OR gate 225, and this low level signal is impressed on one input terminal of a NOR gate 273 through the lines 226 and 272.

Meanwhile, the signal applied to the input terminal 202 is of low level, since the group key 107 is not depressed. This low level signal is applied to a preset input terminal PR of the flip-flop F2 through a line 274. To the clock pulse input terminal CP of the flip-flop F2, the pulse signal of high level impressed on the input terminal 201 is applied through the lines 222 and 275. Accordingly, the flip-flop F2 produces, from the set output terminal Q, a signal of low level applied to the data input terminal D in response to the rising waveform of the pulse signal applied to the clock pulse input terminal CP. This low level signal is applied to the other input terminal of a NOR gate 273 through lines 276 and 277.

According to the above function, a signal of high level is produced from a NOR gate 273, and this high level signal is applied to the output terminal 216 through a line 278, whereby the indicator 110 is illuminated through the driving means 154 so as to indicate that the sorter 2 is to function in the sort mode.

STEP (2b): Positional change-over of the bins 52

When the sorter 2 is subjected to the sort mode function, the copy paper sheets 6, 7 discharged from the copying apparatus main body 1 are supplied into the bins 52 other than the bin 52*a* for the non-sort mode preliminarily selected. Accordingly, when the bin 52*a* is positioned to confront the paper discharge position 73 as shown in FIG. 2, upon depression of the sort key 106 for actuation, it is necessary to shift the bin 52*a* downwards so as to move the bins 52 other than the bin 52*a* to the position confronting the paper discharge position 73.

The pulse signal of high level applied to the input terminal 201 as explained in the STEP (1b), is impressed also on a preset input terminal PR of the flip-flop F7 through a line 222, an OR gate 223 and a line 270, whereby the flip-flop F7 is set, and a signal of high level is output from the set output terminal Q. This high level signal is applied to one input terminal of an AND gate 281 through a line 280. As described previously, when the bin 52*a* is in the state as shown in FIG. 2, where the bin 52*a* is located in the position confronting the paper discharge position 73, the signal applied to the input terminal 207 from the detector 98 is of high level. This high level signal is applied to the other input terminal of the AND gate 281 through the lines 227 and 228. Therefore, a signal of high level is output from the AND gate 281, and this high level signal is impressed on one input terminal of an OR gate 283 through a line 282. Therefore, a signal of high level is produced from the OR gate 283, and this high level signal is applied to a preset input terminal PR of the flip-flop F14 through a line 284, whereby the flip-flop F14 is set to produce a signal of high level from the set output terminal Q. This high level signal is impressed on the output terminal 214 through the line 285. Accordingly, the rotating drive means 153 is forwardly rotated through the driving means 156, with a consequent downward movement of the bin 52. This bin 52 to be shifted downward as described above is the bin indicated by the numeral **52*b* as is clear from FIG. 2. It is to be noted that in the above case, the signal applied to the input terminal 207 becomes low level as the bin 52*b*** is shifted.

STEP (3b): Prohibition of copying during positional change-over of the bins 52

During the movement of the bins 52, the flip-flop F7 remains set as explained in the STEP (2b), and therefore, a signal of low level is output from the reset output terminal $\overline{Q}$ of the flip-flop F7. The low level signal is applied to one input terminal of a NOR gate 286. In the above case, the signal applied to the input terminal 207 also becomes low level upon shifting of the bin **52*b* as explained in the STEP (2b), and this low level signal is applied to the other input terminal of the NOR gate 286 through lines 227 and 228. Accordingly, a signal of high level is developed from the NOR gate 286, and this high level signal is impressed on a preset input terminal PR of the flip-flop F8 through a line 287, an OR gate 288 and a line 289. Accordingly, the flip-flop F8 is set to produce a signal of high level from the set output terminal Q. This high level signal is applied to one input terminal of the OR gate 245 through a line 290, the OR gate 233, the line 234, the OR gate 235 and the line 236, whereby a signal of high level is produced from the OR gate 245. This high level signal is impressed on the output terminal 218 through the line 219, and thus, the driving means 150 is prevented from driving the optical device 17, photosensitive drum 23, feeding rollers 8 and 9 and the other rollers. Accordingly, when the bins 52 are moving in a case other then when they are moving for sorting the copy paper sheets 6, 7 discharged from the copying apparatus main body 1, the copying apparatus main body 1 does not effect a copying operation, even if the print button 101 is depressed by mistake, in the manner similar to that of the STEP (3a). Therefore, the copy paper sheets 6, 7 are not discharged from the copying apparatus main body 1, and the, occurrence of paper jamming, etc. in the sorter 2 can be prevented. Meanwhile, when the signal produced from the output terminal 218 is of high level, the driving means 154 illuminates the indicator 140** fur indication of prohibition of copying to the operator.

STEP (4b): Suspension of shifting of the bins 52 upon completion of positional change-over of the bins 52

To a preset input terminal PR of the flip-flop F4, a signal from the input terminal 211 is applied, while a signal of low level is applied to the input terminal 211, in the state where the print button 101 is not depressed for actuation, i.e. in the state where the copying apparatus main body 1 is not effecting a copying operation. Accordingly, a signal of low level is produced from the set output terminal Q of the flip-flop F4, and this low level signal is applied to the data input terminal D of the flip-flop F5. Accordingly, a signal of low level is produced from the set output terminal Q of the flip-flop F5, and this low level signal is impressed on a preset input terminal PR of the flip-flop F12 through a line 327. In this case, the flip-flop F12 produces, from the set output terminal Q, the signal of high level applied to the data input terminal D, only when a pulse signal of high level is impressed on the clock pulse input terminal CP, i.e. when a pulse signal of high level is applied to the input terminal 208 as described later. In this STEP (4b), the signal applied to the clock pulse input terminal CP of the flip-flop F12 is of low level, and therefore, a signal of low level is produced from the set output terminal Q of the flip-flop F12. The low level signal as described above is applied to one input terminal of the OR gate 283 through lines 305 and 306.

When the bin **52*b* is shifted as explained in the STEP (2b) and detected by the detector 97, a signal of high level is applied to the input terminal 206. This high level signal is impressed on the clear input terminal CL of the flip-flop F7 through a lne 307, whereby the flip-flop F7 is reset, and a signal of low level is produced from the set output terminal Q. This low level signal is applied to one input terminal of the AND gate 281 through the line 280, whereby a signal of low level is produced from the AND gate 281, and this low level signal is applied to one input terminal of the OR gate 283 through the line 282**.

As explained in the STEP (5a) of the non-sort mod (A), a signal of low level is produced from the output terminal C0 of the counter CNT. This low level signal is applied to one input terminal of an AND gate 308 through the line 261, whereby a signal of low level is produced from the AND gate 308, and this low level signal is applied to the remaining input terminal of the OR gate 283 through a line 404. Thus, a signal of low level is produced from the OR gate 283, and this low level signal is applied to the preset input terminal PR of the flip-flop F14 through the line 284. Immediately after movement of the bin **52*b* to the paper discharge position 73, a signal of high level is applied to the input terminal 205, and this high level signal is applied to the clock pulse input terminal CP of the flip-flop F14 through the lines 246 and 247. Accordingly, the flip-flop F14 produces, from the set output terminal Q, a signal of low level applied to the data input terminal D in response to the rising waveform of the signal impressed to the clock pulse input terminal CP. The signal of low level output is applied to the output terminal 214 through the line 285. Accordingly, driving of the rotating drive means 153 is suspended through the driving means 156 and consequently, shifting of the bins 52 is stopped. When the sorter 2 is brought into the state capable of starting the sort mode function in the above described manner, shifting of the bins 52 is suspended. This state is shown in FIG. 7**.

STEP (5b): Releasing from prohibition of copying

When the bins **52*b* has been shifted to the position confronting the paper discharge position 73 as described above, a signal of high level is applied to the input terminal 206. This high level signal is applied to the other input terminal of the OR gate 249 through a line 307, whereby a signal of high level is produced from the OR gate 249, and this high level signal is applied to the clear input terminal CL of the flip-flop F8. Accordingly, the flip-flop F8 is reset, and a signal of low level is produced from the set output terminal Q of the flip-flop F8. This low level signal is applied to the other input terminal of the OR gate 233**.

On the other hand, in the sort mode (B), signal of low level is produced from the reset output terminal $\overline{Q}$ of the flip-flop F1. This low level signal is applied to the other input terminal of the AND gate 230 through the lines 224 and 231. Accordingly, a signal of low level is produced from the AND gate 230, and this low level signal is impressed on one input terminal of the OR gate 233.

Therefore, a signal of low level is produced from the OR gate 233, and functions similar to those in the STEP (5a) in the non-sort mode (A) as described previously are effected in the electrical circuit 152, and thus, the signal applied to the output terminal 218 becomes low level, whereby it becomes possible for the driving means 150 to drive the optical device 17, photosensitive drum 23, feeding rollers 8 and 9 and the other rollers. Meanwhile, the driving means 154 illuminates the indicator 141, whereby the operator is notified that copying has become possible.

As described so far, in the STEPS (1b) to (5b), upon depression of the sort key 106 for actuation, if the bins 52 are not in a state suitable for carrying out the sort mode function, i.e. in the state as shown in FIG. 2, the bin **52*b* is shifted and the bins 52 are brought into the positions suitable for effecting the sort mode function. Moreover, when the bin 52*b* is shifted into the position as described above, the actuation of the print button 101 through depression is prohibited to prevent paper jamming from taking place in the sorter 2**.

STEP (6b): Classification of the set number of sheets

Figure 11:
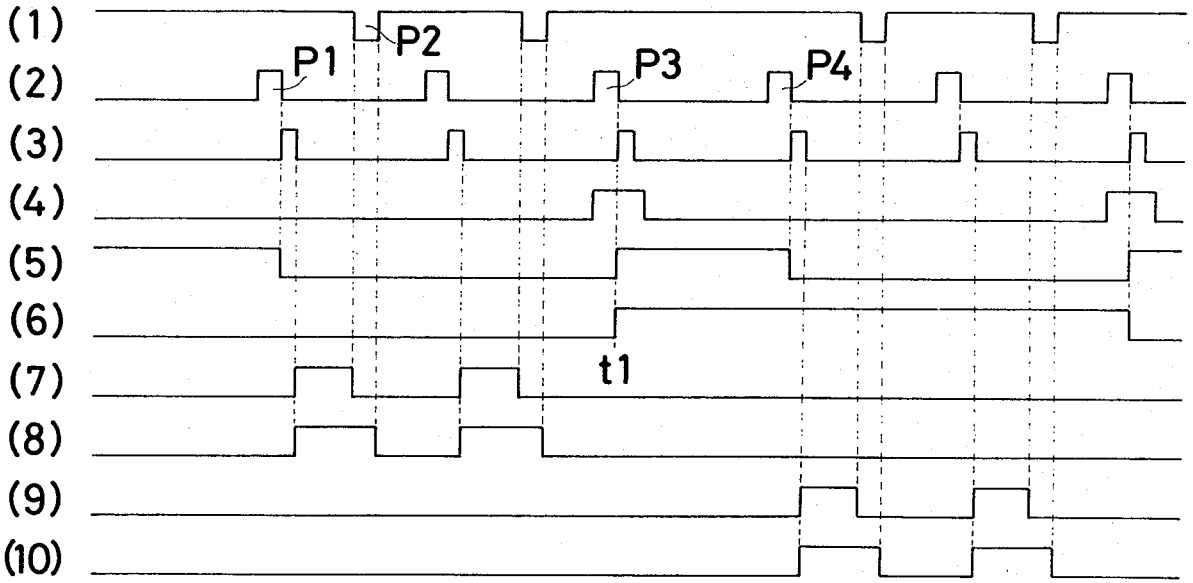
FIGS. 11 and 12 are drawings of waveforms to explain the operation of the electrical circuit.

Subsequently, in the sort mode function of the sorter 2, functioning of the electrical circuit 152 when the copying apparatus main body 1 carries out a copying operation by the number of sheets preliminarily set, will be explained hereinbelow. Reference is made to FIG. 11 showing waveforms for explaining the functions of the electrical circuit 152 when the preliminarily set number of sheets to be copied is three sheets. Upon depression of the print button 101, when the copying apparatus main body 1 is subjected to the copying operations, the copied paper sheets 6,7 are discharged from the copying apparatus main body 1 through the discharge rollers 37. When the first sheet of the copied paper sheets 6 and 7 is discharged from the copying apparatus main body 1, a pulse signal of high level as shown at P1 in FIG. 11 (2) is applied to the input terminal 208. This pulse signal of high level is impressed on one input terminal of an AND gate 311 through a line 310. In the above case, the signal applied to the input terminal 207 is of low level, and this low level signal is applied to an inverter 242 through the line 227. Therefore, a signal of high level is produced from the inverter 242, and is applied to the other input terminal of the AND gate 311 through a line 312 which branches off from the line 243, whereby a pulse signal of high level is produced from the AND gate 311 so as to be impressed on a differentiation circuit 320. The differentiation circuit 320 outputs a pulse signal of high level as shown in FIG. 11 (3) in response to the falling waveform of the high level pulse signal applied thereto as above. The high level pulse signal from the circuit 320 is impressed on the clock pulse input terminal CP of the flip-flop F9 through lines 313 and 314.

In the state as explained in the STEP (1b), the high level pulse signal applied to the input terminal 201 is impressed on a preset input terminal PR of the flip-flop F9 through a line 222, an OR gate 223, lines 270 and 315, an OR gate 316 and a line 317, and thus, the flip-flop F9 is kept in the set state. However, in this STEP (6b), a signal of low level is applied to the preset input terminal PR of the flip-flop F9, whereby the flip-flop F9 outputs, from the set output terminal Q, a signal impressed on the data input terminal D from the input terminal 210 through a line 318, in response to the rising waveform of the high level pulse signal from the differentiation circuit 320. In the state where the preliminarily set number of sheets to be copied does not coincide with the number of sheets discharged, a signal of low level as shown in FIG. 11 (4) is applied to the input terminal 210, and therefore, a signal of low level is produced from the set output terminal Q of the flip-flop F9 as shown in FIG. 11 (5). This low level signal is impressed on one input terminal of a NOR gate 322 through a line 321.

Meanwhile, in the state as explained in the STEP (1b), the pulse signal of high level applied to the input terminal 201 is applied to the clear input terminal of the flip-flop F10 through a line 323 which branches off from the line 317 so as to establish the reset state. Moreover, since the signal applied from the set output terminal Q of the flip-flop F9 to the clock pulse input terminal CP through the line 321, is of low level, the flip-flop F10 is not released from the reset state, with a signal of low level being produced from the set output terminal Q as shown in FIG. 11 (6). This low level signal is applied to one input terminal of a NOR gate 322 through a line 324.

In the above case, a signal of low level is being produced from the set output terminal Q of the flip-flop F2 as explained in the STEO (1b), and this low level signal is applied to the remaining input terminal of the NOR gate 322 through the lines 276, 277 and 325. Accordingly, signal a of high level is produced from the NOR gate 322 so as to be applied to one input terminal of the OR gate 326. Therefore, a signal of high level is produced from the OR gate 326 so as to be applied to the data input terminal D of the flip-flop F12.

As described earlier in the STEP (4b), to the preset input terminal PR of the flip-flop F12, a signal of low level is applied from the set output terminal Q of the flip-flop F5 through a line 327. In the above case, to the clock pulse input terminal CP of the flip-flop F12, a pulse signal of high level from the differentiation circuit 320 shown in FIG. 11 (3), as inverted into a pulse signal of low level through an inverter 328, is applied through a line 510. Accordingly, the flip-flop F12 produces a signal of high level as shown in FIG. 11 (7) from the set output terminal Q, in response to the rising waveform of the pulse signal applied to the clock pulse input terminal CP. This high level signal is applied to one input terminal of the OR gate 283 through the lines 305 and 306. Therefore, a signal of high level is produced from the OR gate 283, and this high level signal is impressed on the preset input terminal PR of the flip-flop F14 through the line 284. Therefore, the flip-flop F14 is set, and a signal of high level is produced from the set output terminal Q as shown in FIG. 11 (8). This high level signal is further applied to the output terminal 214 through the line 285. Accordingly, the rotating drive means 153 is rotated in the forward direction through the driving means 156, and consequently, the bins 52 are shifted downwards.

When the bins 52 are moved downwards as described above, a pulse signal of low level as indicated by the symbol P2 in FIG. 11 (1) is applied to the input terminal 205, and this pulse signal of low level is applied to an inverter 300 through the line 246. The high level pulse signal produced from the inverter 300 is impressed on a clear input terminal CL of the flip-flop F12 through lines 301 and 302. Therefore, the flip-flop F12 is reset so as to produce a signal of low level as shown in FIG. 11 (7) from the set output terminal Q. This low level signal is applied to the OR gate 283 through lines 305 and 306. In this case, the signal applied to the remaining two input terminals of the OR gate 283 through lines 282 and 404 is of low level in a manner similar to that explained in the STEP (4b), and therefore, the signal produced from the OR gate 283 becomes low level. Upon one rotation of the rotary shaft 60, immediately before completion of movement of the bins 52 downwardly by one bin, a signal of high level as shown in FIG. 11 (1) is applied to the input terminal 205. This high level signal is applied to the clock pulse input terminal CP of the flip-flop F14 through the lines 246 and 247. Accordingly, the flip-flop F14 produces a signal of low level from the set output terminal Q as shown in FIG. 11 (8), in response to the rising waveform of the high level signal applied to the clock pulse input terminal CP. This low level signal is impressed on the output terminal 214 through the line 285, and therefore, the movement of the bins 52 is stopped.

In the manner as described so far, each time the copy paper sheets 6, 7 are discharged from the copying apparatus main body 1, the bins 52 are shifted downwards one by one, and accordingly, the copy paper sheets 6, 7 are sorted individually into the bins 52, i.e. one sheet into each bin.

Upon discharge of a third sheet of the copy paper sheets 6, 7 from the copying apparatus main body 1, when the preliminarily set number of sheets to be copied coincides with the number of copy paper sheets discharged from the copying apparatus main body 1, a pulse signal of high level as shown in FIG. 11 (4) is applied to the input terminal 210. This pulse signal of high level is applied to the data input terminal D of the flip-flop F9 through the line 318. By the discharge of the third sheet of the copy paper sheets 6 and 7 from the copying apparatus main body 1, a pulse signal of high level as shown by a reference symbol P3 in FIG. 11 (3) is applied from the differentiation circuit 320 to the clock pulse input terminal CP of the flip-flop F9. Therefore, from the set output terminal Q of the flip-flop F9, a signal of high level is produced as shown in FIG. 11 (5). This signal of high level is applied to the clock pulse input terminal CP of the flip-flop F10. The flip-flop F10 is in the reset state, before time t1 at which a signal of high level is applied to the clock pulse input terminal CP, and a signal of high level from the reset output terminal $\overline{Q}$ is impressed on the data input terminal P. Therefore, the flip-flop F10 produces from the set output terminal Q, a signal of high level as shown in FIG. 11 (6), in response to the rising waveform of the high level signal applied to the clock pulse input terminal CP. This high level signal is applied one input terminal of the NOR gate 322, whereby a signal of low level is output from the NOR gate 322, and this low level signal is applied to one input terminal of the OR gate 326.

As described earlier with reference to the STEP (1b), the flip-flop F2 produces a signal of low level from the set output terminal Q, and this low level signal is applied to one input terminal of an AND gate 380 through the lines 276, 277 and 325. Therefore, a signal of low level is output from the AND gate 380, and this low level signal is applied to the other input terminal of the OR gate 326, whereby a signal of low level is produced from the OR gate 326, and this low level signal is applied to the data input terminal D of the flip-flop F12. To the clock pulse input terminal CP of the flip-flop F12, every time the copy paper sheets 6, 7 are discharged from the copying apparatus main body 1, a pulse signal of high level from the differentiation circuit 320 as shown in FIG. 11 (3) is inverted into a pulse signal of low level through the inverter 328 and applied when the last copy paper sheet of the predetermined number of sheets to be copied, i.e. the third sheet, is discharged from the copying apparatus main body 1, a signal of low level is applied to the data input terminal D of the flip-flop F12. Therefore, the flip-flop F12 remains to be set even when the rising waveform of the signal is applied to the clock pulse input terminal CP. Accordingly, as explained previously in the STEP (4b), a signal of low level is produced from the flip-flop F14, and consequently, the movement of the bins 52 is not stopped.

With replacement of the original document by a fresh one, the copying apparatus main body 1 is subjected to the copying function through depression of the print button 101 again, and thus, the first sheet of the copy paper sheets 6, 7 discharged from the copying apparatus main body 1 is supplied into the same bin 52 as that in which the third copy paper sheet, i.e. the copy paper sheet 6, 7 equivalent to the preliminarily set number, is stored. Upon discharge of the first copy paper corresponding to the fresh original document from the copying apparatus main body 1, a pulse signal of high level indicated by a reference symbol P4 in FIG. 11 (2) is applied to the input terminal 208. This pulse signal of high level is impressed on one input terminal of the AND gate 311 through the line 310. To the other input terminal of the AND gate 311, a signal of high level is applied as described earlier, and accordingly, a signal of high level is produced from the AND gate 311. This high level signal is then applied to the differentiation circuit 320, whereby the differentiation circuit 320 produces a pulse signal of high level as shown in FIG. 11 (3), and this high level signal is impressed on the clock pulse input terminal CP of the flip-flop F9 through lines 313 and 314.

In the above case, to the data input terminal D of the flip-flop F9, a signal of low level is applied from the input terminal 210 as shown in FIG. 11 (4), and therefore, a signal of low level as indicated in FIG. 11 (5) is produced from the set output terminal Q of the flip-flop F9, while simultaneously, a signal of high level is output from the reset output terminal $\overline{Q}$ of the flip-flop F9, and this high level signal is applied to one input terminal of an AND gate 701 through a line 700. In this case, a signal of high level as shown in FIG. 11 (6) is produced from the set output terminal Q of the flip-flop F10, and this high level signal is impressed on the other input terminal of the AND gate 701 through a line 702, whereby a signal of high level is output from the AND gate 701, and this high level signal is applied to the data input terminal D of the flip-flop F11 through a line 703.

To the clock pulse input terminal CP of the flip-flop F11, a pulse signal of high level from the differentiation circuit 320 as shown by the reference symbol P4 in FIG. 11 (3) is inverted into a pulse signal of low level through the inverter 328 and is applied through the line 510. According to the above function, the flip-flop F11 produces a signal of high level as shown in FIG. 11 (9) from the set output terminal Q, in response to the rising waveform of the pulse signal applied to the clock pulse input terminal CP. This high level signal is impressed on one input terminal of the AND gate 239 through a line 511, the OR gate 237 and line 238. In this case, the low level signal from the input terminal 207 is inverted into a high level signal by the inverter 242, and is applied to the other input terminal of the AND gate 239 through the lines 243 and 244. Accordingly, a signal of high level is produced from the AND gate 239, and this high level signal is applied to a preset input terminal PR of the flip-flop F15 through the line 240, whereby the flip-flop F15 is set to produce a signal of high level as shown in FIG. 11 (10) from the set output terminal Q, and this high level signal is impressed on the output terminal 217 through the line 241. Therefore, the rotating drive means 153 is rotated in the reverse direction through the driving means 156, and consequently, the bins 52 are shifted upwardly.

When the bins 52 are moved upward as described above, a pulse signal of low level as shown in FIG. 11 (1) is applied to the input terminal 205, and this pulse signal of low level is impressed on the inverter 300 through the line 246. The pulse signal of high level produced from the inverter 300 is applied to an OR gate 600 through the lines 301 and 302. A signal of high level from the above OR gate 600 is impressed on the clear input terminal CL of the flip-flop F11 through the line 601. Therefore, the flip-flop F11 is reset, and produces a signal of low level as shown in FIG. 11 (10) from the set output terminal Q. This signal of low level is impressed on the other input terminal of the OR gate 237 through the line 511. In this case, as described earlier with respect to the STEP (5b), a signal of low level is produced from the OR gate 235, and this low level signal is applied to one input terminal of the OR gate 237 through the line 236, whereby a signal of low level is produced from the OR gate 237, and this low level signal is impressed on one input terminal of the AND gate 239 through the line 238. Accordingly, a signal of low level is produced from the AND gate 239. This low level signal is applied to the preset input terminal PR of the flip-flop F15 through the line 240.

Upon one rotation of the rotary shaft 60, immediately before the bins 52 complete moving upwardly by one bin, a signal of high level as shown in FIG. 11 (1) is applied to the input terminal 205. This signal of high level is impressed on the clock pulse input terminal CP of the flip-flop F15 through the lines 246, 247 and 248, whereby the flip-flop F15 produces a signal of low level from the set output terminal Q, in response to the rising waveform of the pulse signal. This signal of low level is impressed on the output terminal 217 through the line 241, whereby the shifting of the bins 52 is suspended.

In the manner as described so far, with the original document being replaced by a fresh one, when the print button 101 of the copying apparatus is again depressed to subject the copying apparatus main body 1 to, the bins 52 are shifted upwardly, one by one, each time the copy paper sheets 6, 7 are discharged from main body 1, and consequently, the copy paper sheets 6, 7 are sorted into the bins 52 one sheet into each bin.

When the third sheet of the copy paper sheets 6, 7 corresponding to the fresh original document is discharged from the copying apparatus main body 1, and the preliminarily set number of sheets to be copied coincides with the number of sheets discharged from the copying apparatus main body 1, a pulse signal of high level as shown in FIG. 11 (4) is applied to the input terminal 210. This high level pulse signal is impressed on the data input terminal D of the flip-flop F9 through the line 318. In the above case, since a pulse signal of high level is applied to the clock pulse input terminal CP of the flip-flop F9 from the differentiation circuit 320 as shown in FIG. 11 (3), a signal of high level is produced from the set output terminal Q of the flip-flop F9 as shown in FIG. 11 (5). In this case, a signal of low level is applied to the data input terminal D of the flip-flop F10, and therefore, a signal of low level is produced from the set output terminal Q as shown in FIG. 11 (5), in response to the rising waveform of the high level signal from the set output terminal Q of the flip-flop F9.

Meanwhile, from the reset output terminal $\overline{Q}$ of the flip-flop F9, a signal of low level is produced, and this low level signal is applied to one input terminal of an AND gate 701 through a line 700, whereby a signal of low level is produced from the AND gate 701, and this signal of low level is applied to the data input terminal D of the flip-flop F11 through the line 703.

To the clock pulse input terminal CP of the flip-flop F11, a pulse signal of high level from the differentiation circuit 320 as shown in FIG. 11 (3) is inverted into a pulse signal of low level by the inverter 328 and is applied through the line 510, each time a copy paper sheet is discharged from the copying apparatus main body 1. When the last copy paper sheet of the preset number of sheets to be copied, i.e. the third sheet of the copy paper sheets 6, 7, is discharged from the copying apparatus main body 1, signal of low level is applied to the data input terminal D of the flip-flop F11, and therefore, the flip-flop F11 produces from the set output terminal Qa, signal of low level as shown in FIG. 11 (10), in response to the rising waveform of the signal applied to the clock pulse signal input terminal CP, whereby the bins 52 are not shifted upward and are stopped in positions where they are located at the paper discharge position 73.

In the manner as described above, in this STEP (6b), each time the print button 101 is depressed for actuation and the copy paper sheets 6, 7 are discharged from the copying apparatus main body 1, the bins 52 are shifted one by one, to confront the paper discharge position 73. Upon coincidence of the preliminarily set number of sheets to be copied, with the number of discharged copied paper sheets, the shifting of the bins 52 is suspended for change-over of the direction of movement thereof. For copying a fresh original document, when the print button 101 is again depressed and the copy paper sheets 6, 7 are discharged from the main body 1, the bins 52 are shifted at each discharging of a copy paper sheet, and the copy paper sheets thus dicharged are again sorted into the bins 52 where the copy paper sheets corresponding to the original document initially copied have been accommodated. As described above, the bins 52 are subjected to reciprocating movements, and the copy paper sheets 6, 7 copied to correspond to the respective original documents are sorted one sheet into each of the corresponding single sheet by one single sheet, in the corresponding bins 52.

STEP (7b): Correction of the number of sheets to be copied

In the function of the STEP (6b), when the bin **52*b* is not in the paper discharge position 73, upon depression of the clear key 104 and/or a key 100 for correction of the preliminarily set number of sheets to be copied, the bin 52*b* in which the copy sheets initially discharged have been sorted, is shifted to the position facing the paper discharge position 73**.

Upon depression of the clear key 104 for actuation, feeding of the copy paper sheets by the feeding rollers 8 and 9 in the copying apparatus main body 1 is suspended. When the copy paper sheets 6, 7 which have been fed by the feeding rollers 8 and 9 before depression of the clear key 104 for actuation have been all discharged from the copying apparatus main body 1, a pulse signal of high level is applied to the input terminal 209. This high level signal is impressed on a preset input terminal PR of the flip-flop F3 through the line 303, whereby the flip-flop F3 is set, and a signal of high level is produced from the set output terminal Q of the flip-flop F3. This high level signal is impressed on the preset input terminal PR of the flip-flop F8 through the line 330, OR gate 288 and line 289. Accordingly, the flip-flop F8 is set to produce a signal of high level from the set output terminal Q. This high level signal is applied to one input terminal of the AND gate 239 through the line 290, OR gate 233, line 234, OR gate 235, line 236, OR gate 237 and line 238. In this case, the signal applied to the input terminal 207 is of low level, and this low level signal is further impressed on the inverter 242 through the line 227. The signal produced from the inverter 242 is of high level, and is applied to the other input terminal of the AND gate 239 through the lines 243 and 244, whereby a signal of high level is produced from the AND gate 239, and this high level signal is impressed on the preset input terminal PR of the flip-flop F15 through the line 240. Therefore, the flip-flop F15 is set to produce a signal of high level from the set output terminal Q. This signal of high level is applied to the output terminal 217 through the line 241, whereby the rotating drive means 153 is rotated in the reverse direction through the driving means 156, and correspondingly, the bins 52 continue to be shifted upwardly. It is to be noted here that, since the bins 52 are not moved until the copy paper sheets 6, 7 have been completely discharged from the copying apparatus main body 1, there is no possibility that the copy paper sheets give rise to paper jamming within the sorter 2.

Even during the movement of the bins 52 as described above, since the signal of high level from the line 236 is applied to the output terminal 218 through the OR gate 245 and line 219, the driving means 150 is prevented from driving the optical device 17, etc. in a manner similar to that of the STEPS (3a) and (3b). Meanwhile, the indicator 140 is lit and driven through the driving means 154 for notification of prohibition of copying to the operator.

When the bins 52 continue to be shifted upwardly and bring the bin **52*b* into the position confronting the paper discharge position 73, a signal of high level is applied to the input terminal 206. This signal of high level is impressed on the clear input terminal CL of the flip-flop F8 through the line 307, OR gate 249, line 331 and line 332, whereby the flip-flop F8 is reset, and a signal of low level is output from the set output terminal Q. This signal of low level is applied to the other input terminal of the OR gate 233. In this case, since the flip-flop F1 is in the set state, a signal of low level is produced from the reset output terminal $\overline{Q}$ of the flip-flop F1, and this signal of low level is applied to the other input terminal of the AND gate 230 through the lines 224 and 231. Accordingly, a signal of low level is output from the AND gate 230, and this signal of low level is further impressed on one input terminal of the OR gate 233 through the line 232. Therefore, a signal of low level is produced from the OR gate 233, and this low level signal is impressed on one input terminal of the OR gate 235 through the line 234. When interruption copying is not performed, a signal of low level is applied to the input terminal 212. This signal of low level is applied to one input terminal of an AND gate 800 through a line 258. Accordingly, the signal produced from the AND gate 800 is of low level, and this signal of low level is impressed on the other input terminal of the OR gate 235, whereby a signal of low level is produced from the OR gate 235. The signal of low level from the OR gate 235 is applied to one input terminal of the OR gate 237 through the line 236**.

In the above case, the input terminal 208 remains low level, since no copy paper sheets are discharged from the copying apparatus main body 1. Accordingly, the signal from the differentiation circuit 320 also remains low level, and thus, the signal to be applied to the clock pulse input terminal CP of the flip-flop F11 through the line 313, inverter 328 and line 510 does not change. Therefore, a signal of low level is output from the set output terminal Q of the flip-flop F11, and this low level signal is applied to the other input terminal of the OR gate 237 through the line 511, whereby a signal of low level is developed from the OR gate 237, and this signal of low level is impressed on one input terminal of the AND gate 239 through the line 238. Accordingly, a signal of low level is produced from the AND gate 239, and this signal of low level is impressed on the preset input terminal PR of the flip-flop F15 through a line 240. Immediately after the bin **52*b* has been shifted to the position confronting the paper discharge position 73 and a signal of high level is applied to the input terminal 206, a signal of high level is applied to the input terminal 205. This signal of high level is applied to the clock pulse input terminal CP of the flip-flop F15 through the lines 246, 247 and 248. The flip-flop F15 produces the signal applied to the data input terminal D, from the set output terminal Q in response to the rising waveform of the signal of high level impressed on this clock pulse input terminal CP, whereby the signal applied to the output terminal 217 is rendered to be of low level, and correspondingly, the movement of the bins 52** is suspended.

In the manner as described above, when the clear key 104 is depressed for actuation and the preliminarily set number of sheets to be copied is corrected, the bin 52 into which the copy paper sheet is initially supplied, i.e. the bin **52*b*, is shifted to the position confronting the paper discharge position 73**.

STEP (8b): Interruption copying

During functioning of the STEP (6b), when the interruption key 103 is depressed for effecting interruption copying, the predetermined bin 52 for the non-sort mode, i.e. the bin **52*a*, is shifted to the position facing the paper discharge position 73**.

When the interruption key 103 is depressed for actuation, a signal of high level is applied to the input terminal 212 from the control means 87. This high level signal is impressed on one input terminal of an AND gate 800 through the line 258, and in this case, the signal applied to the input terminal 207 is of low level, and this signal of low level is applied to the inverter 242 through the line 227. The signal inverted to high level by the inverter 242 is impressed on the other input terminal of the AND gate 800 through the line 243. Accordingly, a signal of high level is produced from the AND gate 800, and this signal of high level is applied to one input terminal of the OR gate 235, whereby a signal of high level is produced from the OR gate 235, and this high level signal is impressed on one input terminal of the AND gate 239 through the line 236, OR gate 237 and line 238. In this case, the signal applied to the input terminal 207 is of low level, and this signal of low level is applied to the inverter 242 through the line 227. The signal produced from the inverter 242 is of high level and is impressed on the other input terminal of the AND gate 239 through the lines 243 and 244, whereby a signal of high level is produced from the AND gate 239, and this high level signal is applied to the preset input terminal PR of the flip-flop F15 through the line 240. Accordingly, the flip-flop F15 is set to produce a signal of high level from the set output terminal Q, and this signal of high level is impressed on the output terminal 217 through the line 241. Therefore, the rotating drive means 153 is rotated in the reverse direction through the driving means 156, and correspondingly, the bins 52 continue to move upwardly. It should be noted here that, in the above case, the signal of high level to be imparted to the input terminal 212 is applied thereto by the control means 87 after the copying apparatus main body 1 has stopped the copying operation through the depression of the interruption key 103 and the copy paper sheets 6, 7 have been completely discharged from main body 1. Accordingly, the bins 52 are not shifted until the copy paper sheets have been completely discharged from the copying apparatus main body 1, and therefore, there is no possibility that jamming of the copy paper sheets takes place within the sorter 2.

Even during the movement of the bins 52 as described above, the signal of high level from the line 236 is applied to the output terminal 218 through the OR gate 245 and line 219 in a manner similar the STEP (7b) described previously, and therefore, the driving means 150 is prevented from driving the optical device 17, etc. Meanwhile, the indicator 140 is illuminated and driven through the driving means 154 for indicating to the operator that copying is prohibited.

When the bins 52 are shifted through depression of the interruption key 103 as described above, the flip-flop F8 remains to be reset as explained in the STEP (5b), with the flip-flop F1 remaining to be set, and therefore, the signal from the AND gate 230 also remains of low level. Accordingly, the signal produced from the OR gate 233 is of low level, and this signal of low level is applied to one input terminal of the OR gate 260 through the lines 234 and 259. Meanwhile, the flip-flop F7 is also in the reset state, and the signal of low level produced from the set output terminal Q of the flip-flop F7 is impressed on the other input terminal of the OR gate 260 through a line 520.

In the above case, a signal of low level is produced from the set output terminal Q of the flip-flop F11, and this signal of low level is applied to one input terminal of an OR gate 532 through a line 531 which branches off from the line 511. Meanwhile, a signal of low level is produced from the set output terminal Q of the flip-flop F12, and this low level signal is impressed on the other input terminal of the OR gate 532 through the lines 305 and 306. Therefore, the signal produced from the OR gate 532 is of low level, and this low level signal is impressed on the remaining input terminal of the OR gate 260 through a line 533. Accordingly, the signal produced from the OR gate 260 is of low level, and this low level signal is applied to a preset input terminal PR of the flip-flop F16, whereby the signal produced from the set output terminal Q of the flip-flop F16 is of low level, and this signal of low level is impressed on the clear input terminal CL of the counter CNT, whereby the counter CNT is in a state capable of effecting counting. In this case, to the data input terminal D of the counter CNT, a pulse signal of high level for shifting the bins 52 in the manner as described earlier is applied from the set output terminal Q of the flip-flop F15 through a line 534 which branches off from the line 241. On the other hand, to the clock pulse input terminal CP of the counter CNT, a pulse signal which is applied to the input terminal 205 every time the bins 52 are shifted, one by one, is impressed through the line 246, inverter 300, and line 301. Therefore, the counter CNT counts through addition, the number of pulse signals applied to the clock pulse input terminal CP, and more specifically, the number of rising waveforms of the pulse signals. The values thus obtained by counting through addition correspond to the number of the bins 52 shifted by the depression of the interruption key 103.

As the bins 52 are continuously moved upward, and when the bin **52*a* is shifted to the position confronting the paper discharge position 73, the signal applied to the input terminal 207 is rendered to be of high level, and this signal of high level is impressed on the inverter 242 through the line 227, whereby a signal of low level is produced from the inverter 242, and this signal of low level is applied to one input terminal of the AND gate 239 through the lines 243 and 244. Therefore, the signal produced from the AND gate 239 is rendered to be of low level, and this signal of low level is applied to the preset input terminal PR of the flip-flop F15 through the line 240. According to the above function, a signal of high level is applied to the input terminal 205 from the detecting portion 92 of the detecting means 90, immediately after the bin 52*a* has been shifted, i.e. immediately after the bin 52*a* has been moved to the position confronting the paper discharge position 73, with the bin 52*b* positioned in the state as shown in FIG. 2, and a signal of high level is applied to the input terminal 207 from the detector 98. Therefore the flip-flop F15 produces from the set output terminal Q a signal of low level applied to the data input terminal D, in response to the rising waveform of the high level signal impressed on the clock pulse input terminal CP through the input terminal 205, line 246, and lines 247 and 248. Accordingly, the signal applied to the output terminal 217 is rendered to be of low level, with a consequent suspension of shifting of the bins 52**. Moreover, the signal applied to the data input terminal D of the counter CNT also becomes low level.

In the manner as described above, when the interruption key 103 is depressed for actuation and interruption copying is effected, the bin **52*a* for the nonsort mode is shifted to the position confronting the paper discharge position 73. Accordingly, the copy paper sheet discharged from the copying apparatus main body 1 corresponding to the original document for interruption copying is to be supplied into the bin 52*a***.

Upon completion of the interruption copying, when the interruption key 103 is again depressed, the signal applied to the input terminal 212 is rendered to be of low level. This signal of low level is applied to an inverter 536 through the lines 258 and 535, whereby a signal of high level is produced from an inverter 536, and this signal of high level is impressed on the other input terminal of the AND gate 308 through a line 537.

In the above case, the count value of the counter CNT is larger than 0, and therefore a signal of high level is produced from the output terminal CO of the counter CNT, and this signal of high level is applied to one output terminal of the AND gate 308 through the line 261. Accordingly, a signal of high level is produced from the AND gate 308, and this signal of high level is impressed on the preset input terminal PR of the flip-flop F14 through the line 404, OR gate 283 and line 284, whereby the flip-flop F14 is set to produce a signal of high level from the set output terminal Q, and thus, the bins 52 are shifted downward.

To the clock pulse input terminal CP of the counter CNT, the pulse signal applied to the input terminal 205, each time the bins 52 move, is applied through the line 246, inverter 300 and line 301. In this case, the signal from the set output terminal Q of the flip-flop F15 applied to the data input terminal D of the counter CNT is of low level as described earlier. The counter CNT subtracts from the count value through addition as described previously, the number of pulse signals applied to the clock pulse input terminal CP, and more specifically, the number of rising waveforms of the pulse signals. When the result of the subtraction reaches 0, a signal of low level is produced from the output terminal CO of the counter CNT, and correspondingly, the signal developed from the AND gate 308 becomes low level, and thus, the shifting of the bins 52 is suspended. In this case, the bin 52 located at the paper discharge position 73 is the bin 52 which was located at the paper discharge position 73 when the interruption key 103 was depressed.

As described in the foregoing, when the interruption key 103 is depressed for actuation, the predetermined bin **52*a* for the non-sort mode is positioned at the paper discharge position 73, and upon being released from interruption copying, when the interruption key 103 is depressed for actuation, the bin 52 located at the paper discharge position 73** is returned to the original position.

(C) Group mode

STEP (1c): Group mode indication

For sorting the plurality of copied paper sheets 6, 7 discharged from the copying apparatus main body 1 into groups, each including a plurality of sheets supplied into each bin, with the use of the sorter 2, the group key 107 is depressed for actuation, whereby a pulse signal of high level is applied to the input terminal 202. This high level pulse signal is impressed on the preset input terminal PR of the flip-flop F2 through the line 274. By the above function, a signal of low level is output from the reset output terminal $\overline{Q}$ of the flip-flop F2, and this signal of low level is applied to one input terminal of a NOR gate 351 through a line 350. Meanwhile, a pulse signal of high level from the input terminal 202 is impressed on the input terminal of the OR gate 223 through a line 352 branched from the line 274. Accordingly, a signal of high level is produced from the OR gate 223, and this signal of high level is applied to the preset input terminal PR of the flip-flop F1 through the line 270, whereby the flip-flop F1 is set, and a signal of low level is developed from the reset output terminal $\overline{Q}$. This signal of low level is applied to one input terminal of the OR gate 225 through the line 224. In this case, a signal of low level is applied to the input terminal 212 in the state where the interruption key 103 is not depressed for actuation, and this signal of low level is impressed on the other input terminal of the OR gate 225 through the lines 258 and 271. Accordingly, a signal of low level is output from the OR gate 225, and this signal of low level is impressed on the other input terminal of the NOR gate 351 through the lines 226 and 272. Therefore, a signal of high level is output from the NOR gate 351, and this signal of high level is applied to the output terminal 213 through a line 405. Accordingly, the indicator 111 is illuminated through the driving means 154 for indication that the sorter 2 is in the group mode function.

STEP (2c): Positional change-over of the bins 52

When the sorter 2 is subjected to the group mode function, the copy paper sheets 6, 7 discharged from the copying apparatus main body 1 are supplied into the bins 52 other than the bin **52*a* preliminarily selected for the non-sort mode in a manner similar to the STEP (2b) of the sort mode (A). In the case, the only difference from the STEP (2b) in the functioning of the electrical circuit 152 is that the signal of high level applied to the preset input terminal PR for setting the flip-flop F7 is impressed from the input terminal 202 through the lines 274, 352, OR gate 223 and line 270**.

STEP (3c): Prohibition of copying during the positional change-over of the bins 52

This STEP (3c) is generally similar to the STEP (3b) described previously, and the only difference from the STEP (3b) in the functioning of the electrical circuit 152 is that the signal of high level applied to the preset input terminal PR for setting the flip-flop F7 is impressed from the input terminal 202 through the lines 274, 352, OR gate 223 and line 270 in a manner similar to the STEP (2c) described earlier.

STEP (4c): Suspension of shifting of the bins 52 upon completion of positional change-over of the bins 52

This STEP (4c) is generally the same as the STEP (4b) described earlier, and the only difference thereof from the STEP (4b) in the function of the electrical circuit 152 is that the signal of high level applied to the preset input terminal PR for setting the flip-flop F7 is impressed from the input terminal 202 through the lines 274, 352, OR gate 223 and line 270.

STEP (5c): Releasing of prohibition of copying

The STEP (5c) is generally similar to the STEP (5b) described earlier, and the only difference thereof from the STEP (5b) in the function of the electrical circuit 152 is that the signal of high level applied to the preset input terminal PR for setting the flip-flop F7 is impressed from the input terminal 202 through the lines 274, 352, OR gate 223 and line 270 in a manner similar a the STEPS (2c), (3c) and (4c) described previously.

As described so far, in the STEPS (1c) to (5c), when the bins 52 are not in positional states suitable for effecting the group mode function upon depression of the group key 107, i.e. when the bins 52 are in the state as shown in FIG. 2, the bin **52*b* is shifted and the bins 52 are brought into the positional state suitable for effecting the group mode function. Moreover, when the bin 52*b* is shifted to establish such a positional state, the copying apparatus main body 1 is prohibited from effecting the copying function, and thus, occurrence of paper jamming within the sorter 2** is advantageously prevented.

STEP (6c): Classification of the set number of sheets

Subsequently, functioning of the electrical circuit 152 will be described with reference to the case where the copying apparatus main body 1 is subjected to the copying function by the preliminarily set number of sheets to be copied, in the group mode function of the sorter 2. In the STEP (6b) for the sort mode (A), the bins 52 are shifted each time the copy paper sheets are discharged from the copying apparatus main body 1, and therefore, the copy paper sheets are supplied into the bins 52 one sheet into each bin. In the group mode (C), the bins 52 are shifted when a predetermined number of the copy paper sheets are discharged from the copying apparatus main body 1 into the bins 52.

Figure 12:
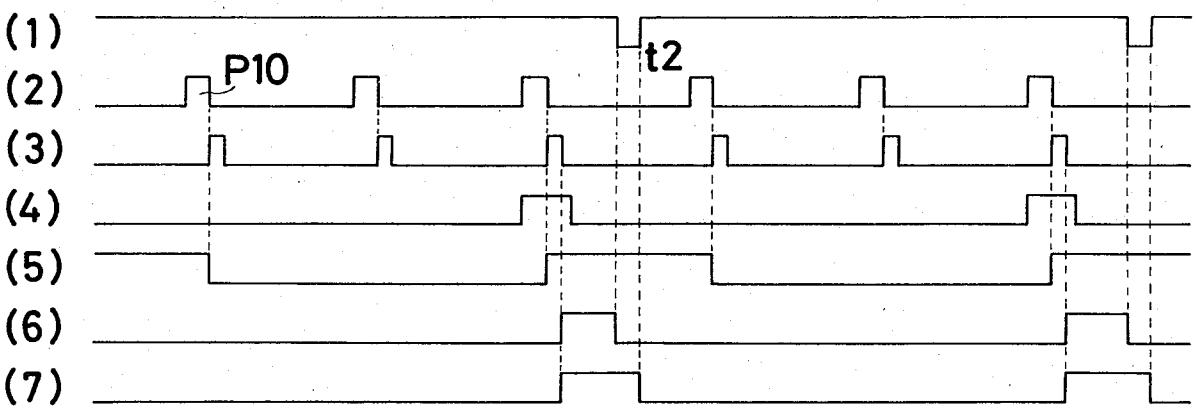

Reference is also made to FIG. 12 showing waveforms explanatory of functioning of the electrical circuit 152 when the preliminarily set number of sheets to be copied in the group mode (C) is three sheets. Upon depression of the print button 101 for actuation, when the copying apparatus main body 1 is subjected to the copying the copy paper sheets 6, 7 are discharged from the copying apparatus main body 1 through the discharge rollers 37. When the first sheet of the copy paper sheets 6 and 7 is thus discharged out of the copying apparatus main body 1, a pulse signal of high level as indicated by a reference symbol P10 in FIG. 12 (2) is applied to the input terminal 208. By this pulse signal of high level, the differentiation circuit 320 develops a pulse signal of high level as shown in FIG. 12 (3) in a manner similar to the functioning state described with reference to the STEP (6b). This pulse signal is applied to the clock input terminal CP of the flip-flop F9 through the lines 313 and 314.

Under the condition described in the STEP (1c), the pulse signal of high level applied to the input terminal 202 by depression of the group key 107 is applied to the preset input terminal PR of the flip-flop F9 through the lines 274 and 352, OR gate 223, lines 270 and 315, OR gate 316 and line 317, and the flip-flop F9 is in the set state. However, in the STEP (6c), the signal of low level is applied to the preset input terminal PR of the flip-flop F9. Therefore, the flip-flop F9 outputs the signal which was applied to the data input terminal D from the input terminal 210 through the line 318, from the set output terminal Q, in response to the rising waveform of the signal of high level from the differentiation circuit 320. The signal of low level shown in FIG. 12(4) is applied to the input terminal 210 when the number of discharged copy sheets does not agree with the preset number of copy sheets, and therefore, a signal of low level outputs from the set output terminal Q of the flip-flop F9. As described in the STEP (1c), when the group key 107 is depressed, the flip-flop F2 is in the set state, and a signal of high level is produced from the set output terminal Q of the flip-flop F2. The signal of high level is applied to the NOR gate 322 through the lines 276, 277 and 325. Therefore, the signal from the NOR gate 322 is low level, and this signal of low level is applied to one input terminal of the OR gate 326.

This time, since a signal of low level shown in FIG. 12(5) is applied to the line 321 from the set output terminal Q of the flip-flop F9, a signal of low level is produced from the AND gate 380, and this signal of low level is applied to the other input terminal of the OR gate 326. Therefore, the signal produced from the OR gate 326 is low level, and the signal applied to the data input terminal D of the flip-flop F12 is low level. A signal applied to the remaining terminals PR, CL and CP of the flip-flop F12 are equal to the signals in the STEP (6b). Therefore, even though the pulse signal of high level is applied to the input terminal 208 every time the copy paper sheets are discharged as shown in FIG. 12(2), the signal of high level is not produced from the set output terminal Q of the flip-flop F12 as shown in FIG. 12(6). Therefore, as in clear from the above-mentioned STEP (6b), since a signal of high level is not applied to the output terminal 214, the bins 52 are not moved.

When the third copy paper sheet is discharged from the copying apparatus 1 and when the preset number of copy paper sheets agrees with the number of discharged copy paper sheets, a signal of high level shown in FIG. 12(4) is applied to the input terminal 210 as in the STEP (6b), and this signal of high level is applied to the data input terminal D of the flip-flop F9 through the line 318. Accordingly, the flip-flop F9 produces the signal of high level which was applied to the data input terminal D in response to the rising waveform of the pulse signal of high level applied to the clock pulse input terminal CP from the differentiation circuit 320, from the set output terminal Q as shown in FIG. 12(5). This signal of high level is applied to one input terminal of the AND gate 380 through the line 321. The signal of high level is applied to the other input terminal of the AND gate 380 from the flip-flop F2. Therefore, a signal of high level is produced from the AND gate 380, and is applied to the data input terminal D of the flip-flop F12 through the OR gate 326.

A signal from the differentiation circuit 320 shown in FIG. 12(3) is applied to the clock pulse input terminal CP of the flip-flop F12 through the inverter 328. Therefore, the flip-flop F12 produces a signal of high level shown in FIG. 12(6) from the set output terminal Q in response to the rising waveform of the signal applied to the clock pulse input terminal CP. This high level signal is applied to the preset input terminal PR of the flip-flop F14 through the lines 305 and 306, OR gate 283 and line 284. Therefore, the flip-flop F14 is in the set state, and a signal of high level is produced shown in FIG. 12(7) from the set output terminal Q. This high level signal is applied to the output terminal 214 through the line 285. Accordingly, the rotating drive means 153 is rotated in a forward direction through the driving means 156, and the bins 52 are shifted downward.

When the bins 52 are shifted downward, a low level pulse signal shown in FIG. 12(1) is applied to the input terminal 205, and this low level pulse signal is impressed on the inverter 300 through the line 246. The pulse signal being inverted to high level by the inverter 300 is applied to the clear input terminal CL of the flip-flop F12 through the lines 301 and 302. The flip-flop F12 being reset, a signal of low level shown in FIG. 12(6) is produced from the set output terminal Q. This low level signal is applied to the OR gate 283 through the lines 305 and 306. Since the signals applied to the remaining two input terminals of the OR gate 283 through the lines 282 and 404 are low level, the output signal from the OR gate 283 is low level. At time t2, when the rotary shaft 60 is rotated for one rotation to shift one bin 52 downward, the signal of high level is applied to the input terminal 205 as shown in FIG. 12(1). This high level signal is applied to the clock pulse input terminal CP of the flip-flop F14 through the lines 246 and 247. Therefore, the flip-flop F14 produces a signal of low level from the set output terminal Q as shown in FIG. 12(7), in response to the rising waveform of the signal applied to the clock pulse input terminal CP. Since this low level signal is applied to the output terminal 214 through the line 285, the bins 52 stop shifting.

As described above, the bins 52 are shifted when the predetermined number of sheets are discharged from the copying apparatus 1. According to the sequence of operation, the predetermined number of copy paper sheets 6, 7 are classified into each of the bins.

STEP (7c): Revise of preset copy number

In the operation of STEP (7b), when there is no copy sheet in one of the bins 52 which is confronted with the paper discharge position 73, the bins 52 are not shifted as is described in the STEP (7c-1) even though the clear key 104 is depressed for revising the preset copy number. On the contrary, when at least one sheet of copy paper is in that bin 52 which is confronted with the paper discharge position 73, the bins 52 are shifted as described in the STEP (7c-2). The condition that there is no copy sheet in one of the bins 52 confronted with the paper discharge position 73 means that the bins 52 have been just shifted after the number of discharged copy sheets agreed with the number of preset copy paper sheets as described in the STEP (6c).

STEP (7c-1)

When the clear key 104 is depressed, feeding of the copy paper sheets 6, 7 by the feed rollers 8 and 9 stops. Upon depression of the clear key 104, a pulse signal of high level is applied to the input terminal 209. This high level pulse signal is applied to the preset input terminal PR of the flip-flop F6 through the lines 303 and 501. Therefore, the flip-flop F6 is in the set state, and a signal of high level is produced from the set output terminal Q. This high level signal is applied to the clock pulse input terminal CP of the flip-flop F5.

The signal output from the set output terminal Q of the flip-flop F12 is high level when the bins 52 are shifted, as described in the STEP (6c). This high level signal is applied to the clear input terminal CL of the flip-flop F4 through the lines 305 and 710, OR gate 711 and line 502. Thus, the flip-flop F4 is reset, and the signal of low level is produced from the set output terminal Q. The reset state of the flip-flop F4 is equal to the state after the bins 52 have been shifted, and this low level signal is applied to the data input terminal D of the flip-flop F5 from the set output terminal Q of the flip-flop F4.

Accordingly, the flip-flop F5 produces a signal of low level from the set output terminal Q in response to the rising waveform of the high level signal applied to the clock pulse input terminal CP. This low level signal is applied to the preset input terminal RP of the flip-flop F12 through the line 327. Thus, since the flip-flop F12 is not set and the flip-flop F14 is not set, the bins 52 are not shifted.

As described above, when there is no copy sheet in one of the bin 52 which is confronted with the paper discharge position 73 just after the bins 52 have been shifted in response to the coincidence between the preset number of copy sheets and the number of discharged sheets, the bins 52 are not shifted even though the clear key 104 is depressed. Therefore, the preset number of copy sheets is revised, and after that, copy sheets discharged from the copying apparatus 1 are sorted into the bins 52 which were not shifted. Thus, shift of the empty bin 52 is prevented.

STEP (7c-2)

When the preset number of copy sheets does not agree with the number of discharged copy sheets, in other words, when the bin 52 confronted with the paper discharge position 73 contains copy sheets of a number fewer than the preset number, upon depression of the clear key 104, the signal produced from the set output terminal Q of the flip-flop F12 is low level as is described with relation to the STEP (6c).

In the copying operation of the copying apparatus, a signal of high level is applied to the preset input terminal PR of the flip-flop F4 from the input terminal 211 and the line 500. Thus the flip-flop F4 is set, and a signal of high level is produced from the set output terminal Q.

When the clear key 104 is depressed, a signal of high level is applied to the clock pulse input terminal CP of the flip-flop F5, as previously described in the STEP (7c-1). Therefore, the flip-flop F5 produces the signal of high level which was applied to the data input terminal D from the set output terminal Q of the flip-flop F4, from the set output terminal Q. This high level signal is applied to the preset input terminal PR of the flip-flop F12 through the line 327. Thus, the flip-flop F12 is set, and a signal of high level is produced from the set output terminal Q. The flip-flop F14 is set according to the high level signal, and the bins 52 are shifted.

Accordingly, when the bins 52 are shifted, the high level signal from the set output terminal Q of the flip-flop F12 is applied to the clear input terminal CL of the flip-flop F5 through the lines 305 and 710, OR gate 711, lines 502 and 503. The flip-flop F5 is reset, and the signal from the set output terminal Q is low level. This low level signal is applied to the preset input terminal PR of the flip-flop F12 through the line 327. Therefore, when the bins 52 are shifted so that the next bin is positioned at the paper discharge position 73, as described earlier related to the STEP (6*c*), the flip-flop F12 is reset, and a signal of low level is produced from the set output terminal Q. This low level signal is applied to the preset input terminal PR of the flip-flop F14 through the lines 305 and 306, OR gate 283 and line 284. Since a signal of high level is applied to the clock pulse input terminal CP of the flip-flop F14 when the bins 52 are shifted so that the next bin is positioned at the paper discharge position as described earlier in the STEP (6*c*), a signal of low level is produced from the set output terminal Q in response to the rising waveform of the high level signal. Therefore, the bins 52 stop shifting.

Thus, when the bin confronting the paper discharge position 73 contains at least one sheet of copy paper, upon depression of the clear key 104, the bins 52 are shifted so that the next bin is at the paper discharge position 73.

STEP (8*c*): Interruption copying

The function of the electrical circuit 152 in STEP (8*c*) is quite equal to that in the STEP (8*b*).

In the sort mode (B) or the group mode (C) described above, when the print button 101 for actuating a copying operation is not depressed after a predetermined period, a signal of high level is applied to the input terminal 203 from the control means 87. This high level signal is applied to the clear input terminal CL of the flip-flops F1 and F2 through the line 750 and OR gate 221. Therefore, the flip-flops F1 and F2 are reset, and signals of high level are produced from each reset output terminals $\overline{Q}$. The function of the electrical circuit 152 is quite equal to that in the STEP (1*a*). Therefore, when the bin **52*a* is not at the paper discharge position 73, the electrical circuit 152** operates similar to STEP (1*a*) to STEP (4*a*). Therefore, in the sort mode function (B) or the group mode function (C) of the sorter 2, when the copying operation has not proceeded, the bin **52*a* used for the non-sort mode function is positioned to the paper discharge position 73** as if the copying operation was completed by the operator.

According to the embodiment of the present invention, the bins 52 are capable of changing moving direction to perform reciprocal movements every time the preset number of copy sheets agrees with the number of discharged copy sheets. Also, the bins 52 may return to the position where the bin 52*b* is at the discharge position every time the preset number of copy sheets agrees with the number of discharged copy sheets, for another embodiment of the invention.

In still another embodiment of the invention, the predetermined bin 52*a* may be replaced by the bin 52*c* which is uppermost positioned.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a copying apparatus equipped with a sorter which sorts a plurality of copy paper sheets, which correspond to an original document and which are discharged from a main body of the copying apparatus, into a plurality of bins which are successively shifted to a sheet discharge position by shifting means, the improvement wherein said sorter comprises:

copy number preset key means for setting the number of copies to be made by the copying apparatus;

memory means for memorizing said preset number of copies to be made;

first counter means for counting the number of copied paper sheets for each copying operation of the copying apparatus;

second counter means for counting the number of copy paper sheets discharged from the copying apparatus;

means for stopping the copying operation of the copying apparatus when the counted value of said first counter means equals said preset number of copies memorized by said memory means;

sort key means for selecting a mode of operation wherein the copy paper sheets are sorted into said bins one sheet into each bin; and electrical circuit means for applying signals to said shifting means for changing the direction of shifting of said bins when the counted value of said second counter means equals the memorized preset number of copies in the sort mode.

2. The improvement claimed in claim 1, wherein said plurality of bins comprises a plurality of plate-like trays spaced vertically at intervals, each said tray being pivotally supported at a downstream end thereof in the discharge direction of the copy paper sheets, by a shaft around a horizontal axis extending at a right angle to said discharge direction, and projections extending outwardly laterally from opposite sides of an upstream end of each said tray widthwise thereof at right angles to said discharge direction, and wherein said shifting means comprises a rotary shaft rotatably mounted about a vertical axis, and a cylindrical cam fixed to said rotary shaft at a position confronting the discharge position, said cylindrical cam including a track groove for guiding said projections for upward and downward movement, whereby said plurality of bins are shifted upward or downward upon clockwise or counterclockwise rotation of said rotary shaft about said vertical axis.

3. In a copying apparatus equipped with a sorter which sorts a plurality of copy paper sheets, which correspond to an original document and which are discharged from a main body of the copying apparatus, into a plurality of bins which are successively shifted to a sheet discharge position by a shifting means, the improvement wherein said sorter comprises:

copy number preset key means for setting the number of copies to be made by the copying apparatus;

memory means for memorizing said preset number of copies to be made;

first counter means for counting the number of copied paper sheets for each copying operation of the copying apparatus;

second counter means for counting the number of copy paper sheets discharged from the copying apparatus;

means for stopping the copying operation of the copying apparatus when the counted value of said first counter means equals said preset number of copies memorized by said memory means;

group key means for selecting a mode of operation wherein a predetermined number of copy paper sheets are sorted into each of said bins; and electrical circuit means for applying signals to said shifting means for shifting said bins when the counted value of said second counter means equals the number of copies preset by said copy number preset key means in the group mode.

4. The improvement claimed in claim 3, wherein said plurality of bins comprises a plurality of plate-like trays spaced vertically at intervals, each said tray being pivotally supported at a downstream end thereof, in the discharge direction of the copy paper sheets, by a shaft around a horizontal axis extending at a right angle to said discharge direction, and projections extending laterally outwardly from opposite sides of an upstream end of each said tray widthwise thereof at right angles to said discharge direction, and wherein said shifting means comprises a rotary shaft rotatably mounted about a vertical axis, and a cylindrical cam fixed to said rotary shaft at a position confronting the discharge position, said cylindrical cam including a track groove for guiding said projections for upward or downward movement, whereby said plurality of bins are shifted upward or downward upon clockwise or counterclockwise rotation of said rotary shaft about said vertical axis.

5. In a copying apparatus equipped with a sorter which sorts a plurality of copy paper sheets, which correspond to an original document and which are discharged from a main body of the copying apparatus, into a plurality of bins which are successively shifted to a sheet discharge position by a shifting means, the improvement wherein said sorter comprises:

copy number preset key means for setting the number of copies to be made by the copying apparatus;

means for revising said preset number of copies to be made;

sort key means for selecting a mode of operation wherein the copy paper sheets are sorted into said bins one sheet into each bin; and electrical circuit means for applying signals to said shifting means for changing the direction of shifting of said bins and to return said bins back to an original position when said preset number is revised by said revising means in said mode.

6. The improvement claimed in claim 5, wherein said plurality of bins comprises a plurality of plate-like trays spaced vertically at intervals, each said tray being pivotally supported at a downstream end thereof, in the discharge direction of the copy paper sheets, by a shaft around a horizontal axis extending at a right angle to said discharge direction, and projections extending laterally outwardly from opposite sides of an upstream end of each said tray widthwise thereof at right angles to said discharge direction, and wherein said shifting means comprises a rotary shaft rotatably mounted about a vertical axis, and a cylindrical cam fixed to said rotary shaft at a position confronting the dischrge position, said cylindrical cam including a track groove for guiding said projections for upward or downward movement, whereby said plurality of bins are shifted upward or downward upon clockwise or counterclockwise rotation of said rotary shaft about said vertical axis.

7. In a copying apparatus equipped with a sorter which sorts a plurality of copy paper sheets, which correspond to an original document and which are discharged from a main body of the copying apparatus, into a plurality of bins which are successively shifted to a sheet discharge position by a shifting means, the improvement wherein said sorter comprises:

copy number preset key means for setting the number of copies to be made by the copying apparatus;

means for revising said preset number of copies to be made;

group key means for selecting a mode of operation wherein a predetermined number of copy paper sheets are sorted into each of said bins; and electrical circuit means for applying signals to said shifting means for shifting said bins so that a second bin adjacent a first bin is at the discharge position when said preset number of copies is revised by said revising means, under the condition that the copied paper sheets are accommodated in said first bin at the discharge position in said mode.

8. The improvement claimed in claim 7, wherein said plurality of bins comprises a plurality of plate-like trays spaced vertically at intervals, each said tray being pivotally supported at a downstream end thereof in the discharge direction of the copy paper sheets, by a shaft around a horizontal axis extending at a right angle to said discharge direction, and projections extending outwardly laterally from opposite sides of an upstream end of each said tray widthwise thereof at right angles to said discharge direction, and wherein said shifting means comprises a rotary shaft rotatably mounted about a vertical axis, and a cylindrical cam fixed to said rotary shaft at a position confronting the discharge position, said cylindrical cam including a track groove for guiding said projections for upward and downward movement, wherein said plurality of bins are shifted upward or downward upon clockwise or counterclockwise rotation of said rotary shaft about said vertical axis.

9. In a copying apparatus equipped with a sorter which sorts a plurality of copy paper sheets, which correspond to an original document and which are discharged from a main body of the copying apparatus, into a plurality of bins which are successively shifted to a sheet discharge position by a shifting means, the improvement wherein said sorter comprises:

copy number preset key means for setting the number of copies to be made by the copying apparatus;

interruption key means for copying another original document by interrupting making of said preset number of copies of said first mentioned original document;

memory means for memorizing the position of said bins when said interruption key means is operating;

sort key means for selecting a mode of operation wherein the copy paper sheets are sorted into said bins through one sheet into each bin, and/or group key means for selecting a mode of operation wherein a predetermined number of copy paper sheets are sorted into each of said bins; and electrical circuit means for applying signals to said shifting means for shifting a predetermined said bin to the discharge position upon operation of said interruption key means, and for applying signals to said shifting means for shifting said bins to said position memorized by the memory means when the interruption copying operation is completed.

10. The improvement claimed in claim 9, wherein said plurality of bins comprises a plurality of plate-like trays spaced vertically at intervals, each said tray being pivotally supported at a downstream end thereof in the discharge direction of the copy paper sheets, by a shaft around a horizontal axis extending at a right angle to said discharge direction, and projections extending outwardly laterally from opposite sides of an upstream end of each said tray widthwise thereof at right angles to said discharge direction, and wherein said shifting means comprises a rotary shaft rotatably mounted about a vertical axis, and a cylindrical cam fixed to said rotary shaft at a position confronting the discharge position, said cylindrical cam including a track groove for guiding said projections for upward and downward movement, whereby said plurality of bins are shifted upward or downward upon clockwise or counterclockwise rotation of said rotary shaft about said vertical axis.

11. In a copying apparatus equipped with a sorter which sorts a plurality of copy paper sheets, which correspond to an original document and which are discharged from a main body of the copying apparatus, into a plurality of bins which are successively shifted to a sheet discharge position by a shifting means, the improvement wherein said sorter comprises:

copy number preset key means for setting the number of copies to be made by said copying apparatus;

sort key means for selecting a mode of operation wherein the copy paper sheets are sorted into said bins one sheet into each bin, and/or group key means for selecting a mode of operation wherein a predetermined number of copy paper sheets are sorted into each of said bins; and means for stopping a copying operation of the copying apparatus regardless of the operation of a print button thereof, during shifting of said bins except for shifting of said bins successively.

12. The improvement claimed in claim 11, wherein said plurality of bins comprises a plurality of plate-like trays spaced vertically at intervals, each said tray being pivotally supported at a downstream end thereof in the discharge direction of the copy paper sheets, by a shaft around a horizontal axis extending at a right angle to said discharge direction, and projections extending outwardly laterally from opposite sides of an upstream end of each said tray widthwise thereof at right angles to said discharge direction, and wherein said shifting means comprises a rotary shaft rotatably mounted about a vertical axis, and a cylindrical cam fixed to said rotary shaft at a position confronting the discharge position, sand cylindrical cam including a track groove for guiding said projections for upward and downward movement, whereby said plurality of bins are shifted upward or downward upon clockwise or counterclockwise rotation of said rotary shaft about said vertical axis.

13. In a copying apparatus equipped with a sorter which sorts a plurality of copy paper sheets, which correspond to an original document and which are discharged from a main body of the copying apparatus, into a plurality of bins which are successively shifted to a sheet discharge position by a shifting means, the improvement wherein said sorter comprises:

copy number preset key means for setting the number of copies to be made by the copying apparatus;

memory means for memorizing said preset number of copies to be made;

counter means for counting the number of copied paper sheets for each copying operation of the copying apparatus;

means for stopping the copying operation of the copying apparatus when the counted value of said counter means equals said preset number of copies memorized by said memory means;

sort key means for selecting a mode of operation wherein the copy paper sheets are sorted into said bins one sheet into each bin, and/or group key means for selecting a mode of operation wherein a predetermined number of copy paper sheets are sorted into each of said bins; and means for applying signals to said shifting means in order to return a predetermined bin to said discharge position after a predetermined period from the time when the copying operation is stopped in said mode.

14. The improvement claimed in claim 13, wherein said plurality of bins comprises a plurality of plate-like trays spaced vertically at intervals, each said tray being pivotally supported at a downstream end thereof in the discharge direction of the copy paper sheets, by a shaft around a horizontal axis extending at a right angle to said discharge direction, and projections extending outwardly laterally from opposite sides of an upstream end of each said tray widthwise thereof at right angles to said discharge direction, and wherein said shifting means comprises a rotary shaft rotatably mounted about a vertical axis, and a cylindrical cam fixed to said rotary shaft at a position confronting the discharge position, said cylindrical cam including a track groove for guiding said projections for upward and downward movement, whereby said plurality of bins are shifted upward or downward upon clockwise or counterclockwise rotation of said rotary shaft about said vertical axis.

* * * * *